US011273459B2

(12) United States Patent
Sakata et al.

(10) Patent No.: US 11,273,459 B2
(45) Date of Patent: Mar. 15, 2022

(54) DISCHARGER

(71) Applicant: YOSHINO KOGYOSHO CO., LTD., Tokyo (JP)

(72) Inventors: Kota Sakata, Tokyo (JP); Katsuhito Kuwahara, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 16/648,268

(22) PCT Filed: Sep. 18, 2018

(86) PCT No.: PCT/JP2018/034403

§ 371 (c)(1),
(2) Date: Mar. 18, 2020

(87) PCT Pub. No.: WO2019/059163

PCT Pub. Date: Mar. 28, 2019

(65) Prior Publication Data

US 2020/0215561 A1 Jul. 9, 2020

(30) Foreign Application Priority Data

Sep. 20, 2017 (JP) ..... JP2017-179795
Nov. 30, 2017 (JP) ..... JP2017-231173

(51) Int. Cl.
*B05B 11/00* (2006.01)

(52) U.S. Cl.
CPC ..... *B05B 11/3009* (2013.01); *B05B 11/3045* (2013.01); *B05B 11/3059* (2013.01)

(58) Field of Classification Search
CPC ..... B05B 11/3009; B05B 11/3045; B05B 11/3059; B05B 11/0059; B05B 11/3023;
(Continued)

(56) References Cited

U.S. PATENT DOCUMENTS 4,082,223 A * 4/1978 Nozawa ..... B05B 11/3009 222/321.8
4,506,805 A * 3/1985 Marcon ..... B05B 11/3057 222/153.13

(Continued)

FOREIGN PATENT DOCUMENTS

CN 204548848 U 8/2015
EP 1317963 A1 6/2003

(Continued)

OTHER PUBLICATIONS

JP 2009 131818 with Machine Translation (Year: 2009).*

(Continued)

*Primary Examiner* — Vishal Pancholi
(74) *Attorney, Agent, or Firm* — Oliff PLC

(57) ABSTRACT

In the discharger, a stopper is swingable between a restriction position which comes into contact with or approaches a locking target portion to restrict downward movement of a discharge head and a restriction release position where the restriction and locking target portions are separated to allow downward movement of the discharge head by the stopper being swung rearward from the restriction position, the stopper including the restriction portion, a finger hook outward from a depressing member in a left-right direction, and a contact target portion that comes into contact with the depressing member when the stopper is at the restriction position or when the depressing member rotates downward around a rotation axis where the stopper is at the restriction position, and a restraint protrusion protruding downward is formed at a portion of the depressing member rearward of a contact portion with which the contact target portion comes into contact.

12 Claims, 17 Drawing Sheets

(58) Field of Classification Search
CPC ..... B05B 11/3071; B05B 11/3047; B05B 11/3014; B65D 83/00; F04B 9/14
See application file for complete search history.

(56) References Cited

U.S. PATENT DOCUMENTS

| | | | | | |
|---|---|---|---|---|---|
| 4,915,263 | A * | 4/1990 | Corba | B05B 11/3011 | 222/321.8 |
| 4,993,214 | A * | 2/1991 | Corba | B05B 11/3011 | 222/321.8 |
| 5,016,780 | A * | 5/1991 | Moretti | B05B 11/3001 | 222/153.13 |
| 5,156,304 | A * | 10/1992 | Battegazzore | B05B 11/3014 | 222/341 |
| 5,615,806 | A * | 4/1997 | Grothoff | B05B 11/3059 | 222/153.13 |
| 6,364,167 | B1 * | 4/2002 | Safian | B05B 11/3001 | 222/153.13 |
| 7,249,692 | B2 * | 7/2007 | Walters | B05B 11/3014 | 222/153.11 |
| 8,556,126 | B2 * | 10/2013 | Lee | B05B 11/3057 | 222/153.13 |
| 8,757,447 | B2 * | 6/2014 | Gill | B05B 11/3011 | 222/153.13 |
| 9,108,213 | B2 * | 8/2015 | Gill | B05B 11/0027 | |

FOREIGN PATENT DOCUMENTS

| | | | |
|---|---|---|---|
| JP | 2003-225595 | A | 8/2003 |
| JP | 2004-209319 | A | 7/2004 |
| JP | 2009-131813 | A | 6/2009 |
| JP | 2009-131818 | A | 6/2009 |
| JP | 2011-251218 | A | 12/2011 |
| JP | 2012-096134 | A | 5/2012 |
| JP | 2012-096135 | A | 5/2012 |
| JP | 3199176 | U | 8/2015 |
| JP | 2017-095168 | A | 6/2017 |
| JP | 2017-100753 | A | 6/2017 |
| JP | 2017-197273 | A | 11/2017 |

OTHER PUBLICATIONS

Nov. 13, 2018 International Search Report issued in International Patent Application No. PCT/JP2018/034403.
Jan. 6, 2021 Office Action issued in Chinese Patent Application No. 201880060522.7.
Mar. 2, 2021 Office Action issued in Japanese Patent Application No. 2017-231173.

* cited by examiner

DISCHARGER

TECHNICAL FIELD

The present invention relates to a discharger.

Priority is claimed on Japanese Patent Application No. 2017-179795, filed Sep. 20, 2017 and Japanese Patent Application No. 2017-231173, filed Nov. 30, 2017, the contents of which are incorporated herein by reference.

BACKGROUND ART

In the related art, a discharger is known which includes a pump that has a discharge head disposed on a mouth portion of a container body in which contents are accommodated so as to be movable downward in an upward force-applied state, the discharge head having a discharge hole opening forward, a mounting cap with which the pump is mounted on the mouth portion of the container body, a support portion that is erected on a rear portion of the mounting cap, and a depressing member that is disposed on the support portion so as to be rotatable around a rotation axis and depresses the discharge head, in which the discharger discharges the contents from the discharge hole by the depressing member being rotated downward around the rotation axis and thereby the discharge head is moved downward. For this type of discharger, for example, as shown in Patent Document 1 below, a configuration is known in which the discharger further includes a stopper that is disposed to be swingable in a front-rear direction and has a restriction portion coming into contact with or approaching the depressing member from below the depressing member, and the stopper is disposed to be swingable between a restriction position where the restriction portion comes into contact with or approaches the depressing member to restrict downward movement of the discharge head and a restriction release position where the restriction portion is separated from the depressing member to allow downward movement of the discharge head by being swung rearward from the restriction position.

In the above configuration, in a state where the stopper is located at the restriction release position, when the depressing member is rotated downward around the rotation axis, the discharge head moves downward and the contents are discharged from the discharge hole.

DOCUMENT OF RELATED ART

Patent Document

[Patent Document 1] Japanese Unexamined Patent Application, First Publication No. 2004-209319

SUMMARY OF INVENTION

Technical Problem

However, in the discharger of the related art, in a state where the stopper is located at the restriction position, for example, when a large force for rotating the depressing member downward around the rotation axis is applied to the depressing member, there is a possibility that the support portion will be deformed, a force for swinging the stopper rearward will be applied to the stopper from the depressing member, and the stopper will be unexpectedly shifted from the restriction position to the restriction release position.

Further, for example, when the discharger is housed in a bag or the like, there is a possibility that another article in the bag may be caught by the depressing member of the discharger. In this state, a case where a large force for rotating the depressing member upward around the rotation axis is inadvertently applied, such as in a case of trying to pull out the other article or the discharger from the bag may be generated. In the discharger, the depressing member and the discharge head are linked to each other, and thus, the discharge head may be pulled out of a stem by the force applied to the depressing member.

The present invention has been realized in view of such circumstances and an object thereof is to provide a discharger in which a stopper located at a restriction position unexpectedly being shifted toward a restriction release position can be inhibited, for example, even if a large force for rotating a depressing member downward around a rotation axis is applied to the depressing member.

Further, another object of the present invention is to provide a discharger that can inhibit a discharge head from being pulled out of a stem, for example, even if a large force for rotating a depressing member upward around a rotation axis is applied to the depressing member.

Solution to Problem

A discharger according to a first aspect of the present invention includes: a pump including a discharge head that is disposed on a mouth portion of a container body, in which contents are accommodated, so as to be movable downward in an upward force-applied state, the discharge head being provided with a discharge hole opening forward; a mounting cap with which the pump is mounted on the mouth portion of the container body; a support portion erected on a rear portion of the mounting cap; and a depressing member that is disposed on the support portion so as to be rotatable around a rotation axis and depresses the discharge head, wherein the discharger is configured to discharge the contents from the discharge hole by rotating the depressing member downward around the rotation axis to move the discharge head downward, wherein the discharger includes a stopper that is disposed to be swingable in a front-rear direction and that includes a restriction portion coming into contact with or approaching a locking target portion formed in at least one of the discharge head and the depressing member from below the locking target portion, wherein the stopper is disposed to be swingable between a restriction position where the restriction portion comes into contact with or approaches the locking target portion to restrict downward movement of the discharge head and a restriction release position where the restriction portion is separated from the locking target portion to allow downward movement of the discharge head by the stopper being swung rearward from the restriction position, wherein the stopper includes the restriction portion, a finger hook located outward from the depressing member in a left-right direction orthogonal to both of the front-rear direction and an up-down direction, and a contact target portion that comes into contact with the depressing member when the stopper is located at the restriction position or when the depressing member rotates downward around the rotation axis in a state where the stopper is located at the restriction position, and wherein a restraint protrusion protruding downward is formed at a portion of the depressing member located rearward of a contact portion with which the contact target portion of the stopper comes into contact.

According to the discharger related to the first aspect of the present invention, since the restraint protrusion is formed in the depressing member, for example, when a large force for rotating the depressing member downward around the rotation axis is applied to the depressing member in a state where the stopper is located at the restriction position, even if a force directed rearward is applied to the contact target portion of the stopper from the contact portion of the depressing member and thus the stopper is shifted toward the restriction release position, the contact target portion of the stopper comes into contact with the restraint protrusion from a side behind the contact target portion, so that the stopper is locked to the restraint protrusion. Accordingly, it is possible to inhibit the stopper located at the restriction position from being unexpectedly shifted toward the restriction release position.

In the first aspect, in the contact target portion, at least a rear end part of an upper end surface with which the contact portion of the depressing member comes into contact may extend gradually downward as it goes rearward.

In this case, since at least a rear end of the upper end surface of the contact target portion of the stopper extends gradually downward as it goes rearward, when the large force described above is applied to the depressing member, even if the stopper is shifted from the restriction position toward the restriction release position, a force directed forward from the restraint protrusion of the depressing member is applied to the upper end surface of the contact target portion, so that it is possible for the stopper 130 to be returned to or kept at the restriction position.

Further, in the first aspect, at least a part of the restraint protrusion may face the rear end part of the upper end surface of the contact target portion in a state where the stopper is located at the restriction position.

In this case, since at least a part of the restraint protrusion faces a rear end of the upper end surface of the contact target portion in a state where the stopper is located at the restriction position, it is possible to reduce a distance between the upper end surface of the contact target portion and the restraint protrusion in a front-rear direction, so that, when the large force described above is applied to the depressing member, it is possible to reliably curb the stopper being shifted from the restriction position to the restriction release position and to effectively apply a force directed forward from the restraint protrusion of the depressing member to the upper end surface of the contact target portion.

A discharger according to a second aspect of the present invention includes: a pump including a stem that is disposed on a mouth portion of a container body, in which contents are accommodated, so as to be movable downward in an upward force-applied state, and a discharge head mounted on the stem and provided with a discharge hole opening forward; a mounting cap with which the pump is mounted on the mouth portion of the container body; a support portion erected on a rear portion of the mounting cap; and a depressing member that is disposed on the support portion so as to be rotatable around a rotation axis and is linked to the discharge head, wherein the discharger is configured to discharge the contents from the discharge hole by rotating the depressing member downward around the rotation axis to move the discharge head downward, and wherein the discharger includes a rising restriction portion coming into contact with or approaching a rising locking portion formed in at least one of the discharge head and the depressing member from above the rising locking portion.

According to the second aspect, in a case where an upward pulling force acts on the depressing member unexpectedly, the rising locking portion abuts against the rising restriction portion from below the rising restriction portion. Accordingly, the upward movement of the discharge head with respect to the stem can be restricted by the rising restriction portion. As a result, even if a large force for rotating the depressing member upward around the rotation axis is applied, the discharge head can be inhibited from being pulled out of the stem.

The discharger according to the second aspect of the present invention may include a stopper that is disposed to be swingable in a front-rear direction and that includes a descending restriction portion coming into contact with or approaching a descending locking portion formed in at least one of the discharge head and the depressing member from below the descending locking portion, wherein the stopper may be disposed to be swingable between a restriction position where the descending restriction portion comes into contact with or approaches the descending locking portion to restrict downward movement of the discharge head and a restriction release position where the descending restriction portion is separated from the descending locking portion to allow downward movement of the discharge head by the stopper being swung rearward from the restriction position.

According to this configuration, in a state where the stopper is located at the restriction position, the descending restriction portion comes into contact with or approaches the descending locking portion, so that the downward movement of the discharge head is restricted. Therefore, it is possible to inhibit the contents from being inadvertently discharged.

On the other hand, in a state where the stopper is located at the restriction release position, the depressing member is rotated downward around the rotation axis, so that the downward movement of the discharge head is allowed. Accordingly, the contents can be discharged through the discharge hole.

In the discharger according to the second aspect of the present invention, the rising restriction portion may be formed in the stopper.

According to this configuration, it is possible to curb an increase in the number of parts and complication of a configuration by forming the rising restriction portion at the stopper.

In the discharger according to the second aspect of the present invention, the support portion may include a guide tube into which the stem is inserted to be movable downward, and the rising locking portion may be formed at a portion of the discharge head protruding upward from the guide tube.

According to this configuration, the rising locking portion can be formed irrespective of dimensions and the like of the discharge head or the guide tube, so that, it is possible to improve a degree of freedom in design, for example.

In the discharger according to the second aspect of the present invention, the support portion may include a guide tube into which the stem is inserted to be movable downward, and wherein the rising locking portion may be formed at a portion of the discharge head located inside the guide tube.

According to this configuration, rising of the discharge head in a lower end of the mounting tube can be restricted. Accordingly, falling down of the discharge head can be reliably inhibited. Further, the design can be improved because the rising restriction portion is not exposed to the outside.

Effects of Invention

According to the discharger related to the first aspect of the present invention, it is possible to inhibit a stopper located at a restriction position from unexpectedly being shifted toward a restriction release position, for example, even if a large force for rotating a depressing member downward around a rotation axis is applied to the depressing member.

Further, according to the discharger related to the second aspect of the present invention, it is possible to inhibit a discharge head from being pulled out of a stem, for example, even if a large force for rotating a depressing member upward around a rotation axis is applied to the depressing member.

DESCRIPTION OF EMBODIMENTS

Hereinafter, an embodiment of a discharger according to the present invention is described with reference to the drawings.

First Embodiment

Figure 1:
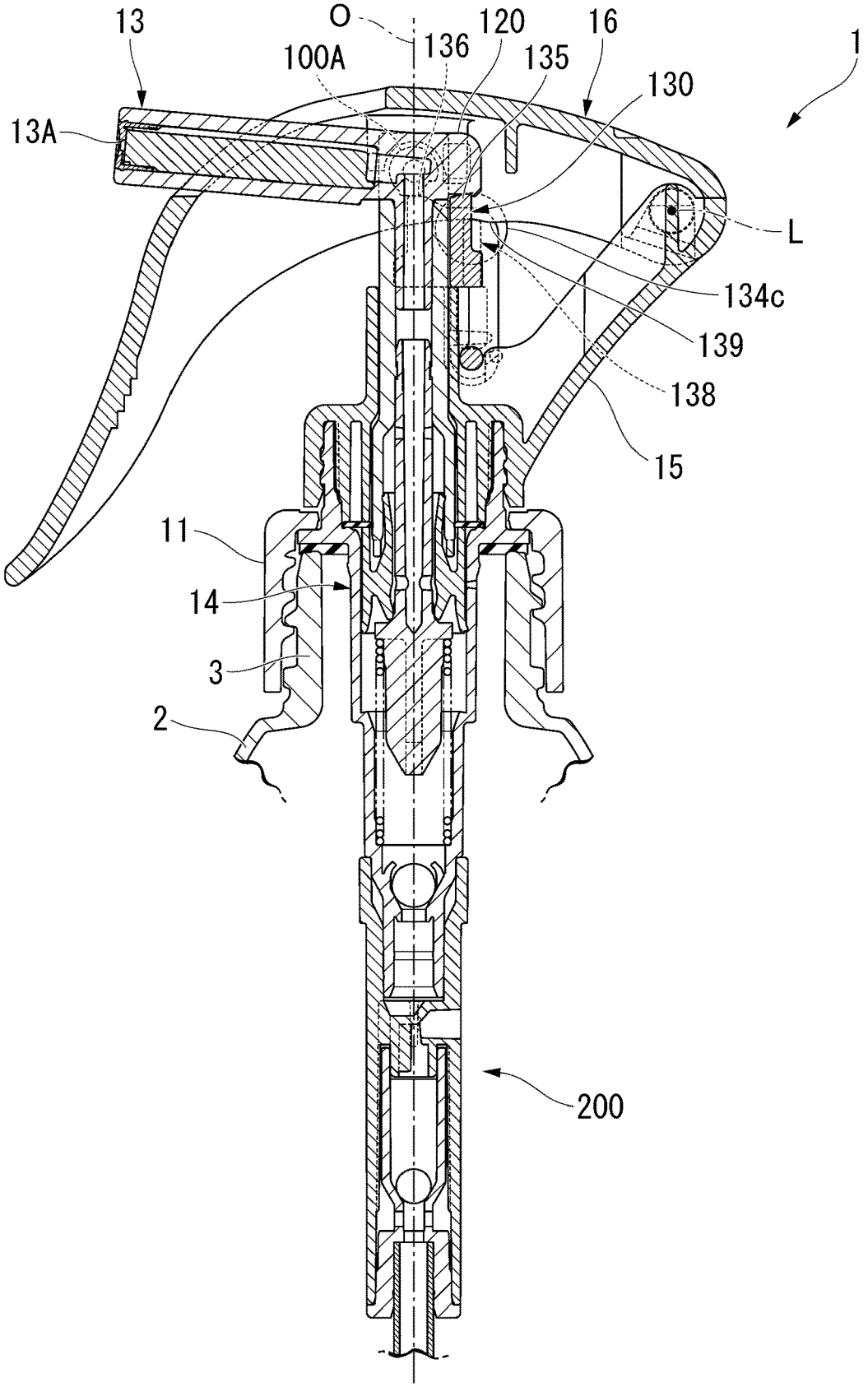
FIG. 1 is a longitudinal sectional view of a discharger according to a first embodiment of the present invention in which an invertible adapter is mounted and a stopper is located at a restriction position, viewed in a left-right direction along an axial direction.

As shown FIG. 1, a discharger 1 includes a pump 14 including a discharge head 13 that is disposed on a mouth portion 3 of a container body 2, in which contents are accommodated, so as to be movable downward in an upward force-applied state, the discharge head being provided with a discharge hole 13A opening forward, a mounting cap 11 with which the pump 14 is mounted on the mouth portion 3 of the container body 2, a support portion 15 erected on a rear portion of the mounting cap 11, and a depressing member 16 that is disposed on the support portion 15 so as to be rotatable around a rotation axis L and depresses the discharge head 13. In the discharger 1, by rotating the depressing member 16 downward around the rotation axis L to move the discharge head 13 downward, the contents are discharged from the discharge hole 13A.

Note that, in the illustrated example, an invertible adapter 200 described later is mounted on the discharger 1.

Figure 2:
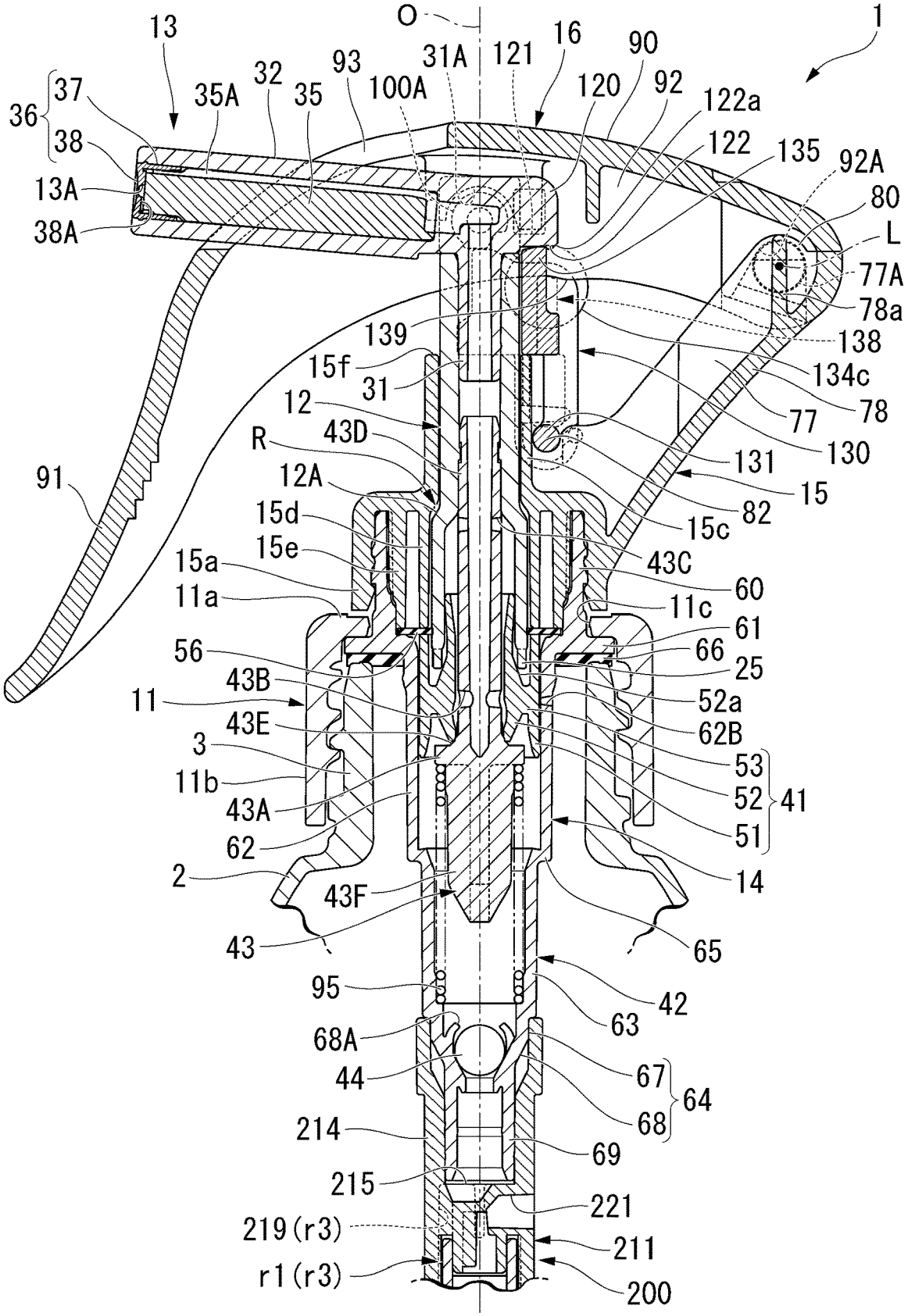
FIG. 2 is a longitudinal sectional view showing an upper half of the discharger shown in FIG. 1.

As shown in FIG. 2, the mounting cap 11 is formed in a topped tubular shape. The mounting cap 11 has an annular top wall 11*a* having an opening 11*c* formed at a center, and a cylindrical peripheral wall 11*b* extending downward from an outer peripheral edge of the top wall 11*a*. A female screw that is screwed into a male screw formed on an outer peripheral surface of the mouth portion 3 of the container body 2 is formed on an inner peripheral surface of the peripheral wall 11*b*.

The pump 14 includes a stein 12 disposed to be movable downward, a coil spring 95 applying an upward force to the stem 12, the discharge head 13 mounted on an upper end of the stem 12, a tubular piston 41 associated with up-down movement of the stem 12, a cylinder 42 in which the piston 41 is accommodated to be slidable upward and downward, and a piston guide 43 extending downward from the stem 12.

Here, the mounting cap 11, the stem 12, the piston 41, the cylinder 42, and the piston guide 43 are disposed with their respective central axes positioned on a common axis.

Hereinafter, this common axis is referred to as a central axis O, and a direction along the central axis O is referred to as an up-down direction. Further, in a plan view viewed in an up-down direction, a direction intersecting the central axis O is referred to as a radial direction, and a direction of revolving around the central axis O is referred to as the circumferential direction. Further, in a radial direction of a plan view, a direction in which the discharge hole 13A of the discharge head 13 opens is referred to as a forward direction, a direction opposite thereto is referred to as a rearward direction, and a direction orthogonal to both an up-down direction and a front-rear direction is referred to as a left-right direction.

The stem 12 is erected on the mouth portion 3 of the container body 2 so as to be movable downward in an upward force-applied state. The inner diameter and the outer diameter of a lower portion of the stem 12 are larger than the inner diameter and the outer diameter of an upper portion of the stein 12. A stepped tube 12A having a tapered shape is formed between an upper portion and a lower portion of the stem 12.

An elastic piece 25 to which a compression force in an up-down direction is applied by the piston 41 and the stem 12, as the stein 12 and the piston guide 43 move downward with respect to the piston 41, is disposed between the stem 12 and the piston 41.

The elastic piece 25 is formed in a plate shape with front and back surfaces thereof facing in a radial direction and extending in an up-down direction. The elastic piece 25 is formed at a lower end opening edge of the stem 12 and is disposed in plural (six in this embodiment) at equal intervals in the circumferential direction. The elastic piece 25 is formed integrally with the stem 12. The plurality of elastic pieces 25 are formed in the same shape and the same size. The radial size (thickness) of the elastic piece 25 is smaller than the thickness of the stem 12. Note that, the stem 12 and the elastic piece 25 are formed of a material having a certain degree of rigidity, such as polypropylene, so that the elastic piece 25 is deformed when a certain amount of force is applied.

The discharge head 13 includes a mounting tube 31 that has a topped tubular shape and is mounted on an upper end of the stem 12, and a nozzle tube 32 that has a tubular shape and protrudes forward from the mounting tube 31.

The mounting tube 31 is fitted into the stem 12. A first locking target portion 120 protruding rearward is formed at an upper end of the mounting tube 31.

The first locking target portion 120 is formed in a block shape having a pair of lightening holes 121 that open in a left-right direction. An engagement projection 122 for preventing a later-described stopper 130 from moving from a restriction position to a restriction release position is formed in the first locking target portion 120.

The engagement projection 122 projects downward from a rear end of the first locking target portion 120. A lower end of the engagement projection 122 is located above an upper end of the stem 12. A slope 122*a* that extends gradually upward as it goes rearward is formed in a rear portion of the engagement projection 122.

Figure 3:
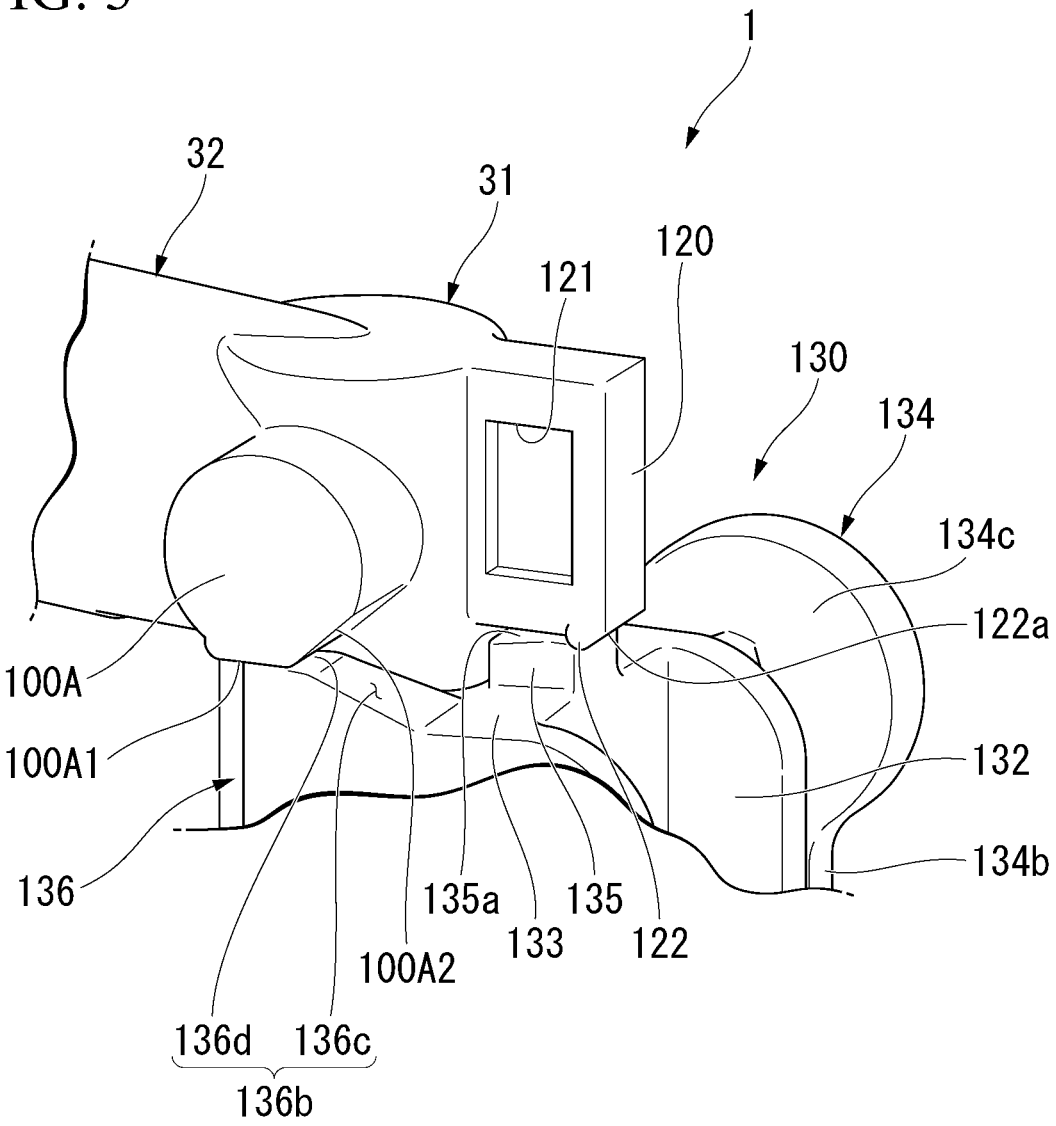
FIG. 3 is a perspective view showing a state where a depressing member is removed from the discharger shown in FIG. 1.

A pair of second locking target portions 100A protruding separately on both sides in a left-right direction are formed at an upper end of the mounting tube 31. The second locking target portion 100A has a circular shape when viewed in a left-right direction. As shown in FIG. 3, a flat surface 100A1 facing downward and an inclined surface 100A2 facing obliquely rearward and downward are formed on an outer peripheral surface of the second locking target portion 100A. The flat surface 100A1 is formed at a lower end of an outer peripheral surface of the second locking target portion 100A, and is, for example, a flat surface orthogonal to an up-down direction. The inclined surface 100A2 is connected to a rear end of the flat surface 100A1 and extends gradually upward as it goes rearward from a rear end of the flat surface 100A1.

As shown in FIG. 2, a core rod 35 that extends in a front-rear direction and a tip 36 that has a topped tubular shape and is attached to a front end of the core rod 35 are disposed in the nozzle tube 32.

A plurality of flow channel grooves 35A extending in a front-rear direction and allowing liquid content to flow between an inner peripheral surface of the nozzle tube 32 and the flow channel groove are formed on an outer peripheral surface of the core rod 35. The tip 36 has a cylindrical tip tube 37 which is disposed coaxially with the core rod 35 and into which the core rod 35 is fitted and an end wall 38 provided at a front end of the tip tube 37.

The tip tube 37 is fitted into the nozzle tube 32. The end wall 38 is in contact with a front end surface of the core rod 35. A spin flow channel 38A communicating with the flow channel groove 35A of the core rod 35 is formed on a rear surface of the end wall 38, being in contact with a front end surface of the core rod 35. In a central portion of the end wall 38, a discharge hole 13A communicating with the spin flow channel 38A opens forward.

The tip 36 allows the liquid content to be discharged in a mist. Further, by changing the tip 36, a nozzle tip end shape, or the like, it becomes possible to discharge the liquid content in a foam, a linear shape, or the like. For example, by providing a foaming member such as a mesh at the nozzle tip end of the present embodiment, it is possible to discharge foam.

The piston 41 includes an outer tube piston 51 that is fitted into the cylinder 42 so as to be slidable upward and downward, an inner tube piston 52 that is disposed on a radial inside of the outer tube piston 51 and surrounds the piston guide 43 from radially outward therefrom, and an annular connection portion 53 that connects the outer tube piston 51 and the inner tube piston 52 to each other. Each of the outer tube piston 51, the inner tube piston 52, and the annular connection portion 53 is disposed coaxially with the central axis O. In the illustrated example, the outer tube piston 51, the inner tube piston 52, and the annular connection portion 53 are formed integrally with one another.

A lower end of the outer tube piston 51 is curved to warp gradually outward in a radial direction as it goes downward from above. A lower end of the outer tube piston 51 comes into contact with an inner peripheral surface of the cylinder 42 so as to move up and down.

A lower end of the inner tube piston 52 is curved to warp gradually inward in a radial direction as it goes downward from above. A lower end of the inner tube piston is in contact with a contact portion 43E formed near a flange 43A described later of the piston guide 43. An upper end of the inner tube piston 52 is curved to warp gradually outward in a radial direction as it goes upward from below, and comes into contact with an inner peripheral surface of a lower end of the stem 12 so as to move up and down.

In an outer peripheral surface of the inner tube piston 52, at a portion connected to an upper end of the annular connection portion 53, a tapered portion 52*a* whose diameter gradually reduces as it goes upward from an upper end of the annular connection portion 53 is formed. The tapered portion 52*a* extends continuously over the entire circumference. Note that, the tapered portion 52*a* may extend intermittently over the entire circumference. The tapered portion 52*a* and a lower end of the elastic piece 25 face each other in an up-down direction.

The cylinder 42 is formed in a multi-stepped cylindrical shape. The cylinder 42 includes an upper tube 62 that extends in an up-down direction, a lower tube 63 that extends downward from a lower end portion of the upper tube 62 and has an inner diameter and an outer diameter smaller than those of the upper tube 62, a small diameter portion 64 that extends downward from a lower end of the lower tube 63 and has an inner diameter and an outer diameter smaller than those of the lower tube 63, an annular stepped portion 65 that connects a lower end of the upper tube 62 and an upper end of the lower tube 63 to each other, and a connection tube 69 that extends downward from a lower end of the small diameter portion 64.

An air hole 62B through which the inside and the outside of the upper tube 62 communicate with each other is formed at an upper portion of the upper tube 62. An annular support plate 61 protruding outward in a radial direction is formed at an upper end of the upper tube 62. A lower surface of the top wall 11*a* the mounting cap 11 is in contact with an outer peripheral portion of an upper surface of the support plate 61. A first packing 66 is disposed between the support plate 61 and an upper end opening edge of the mouth portion 3 of the container body 2. The support plate 61 and the first packing 66 are fixed between the top wall 11*a* of the mounting cap 11 and the mouth portion 3 by screwing the peripheral wall 11*b* of the mounting cap 11 to the mouth portion 3. The support plate 61, the upper tube 62, the lower tube 63, and the small diameter portion 64 are disposed coaxially with the central axis O.

Figure 5:
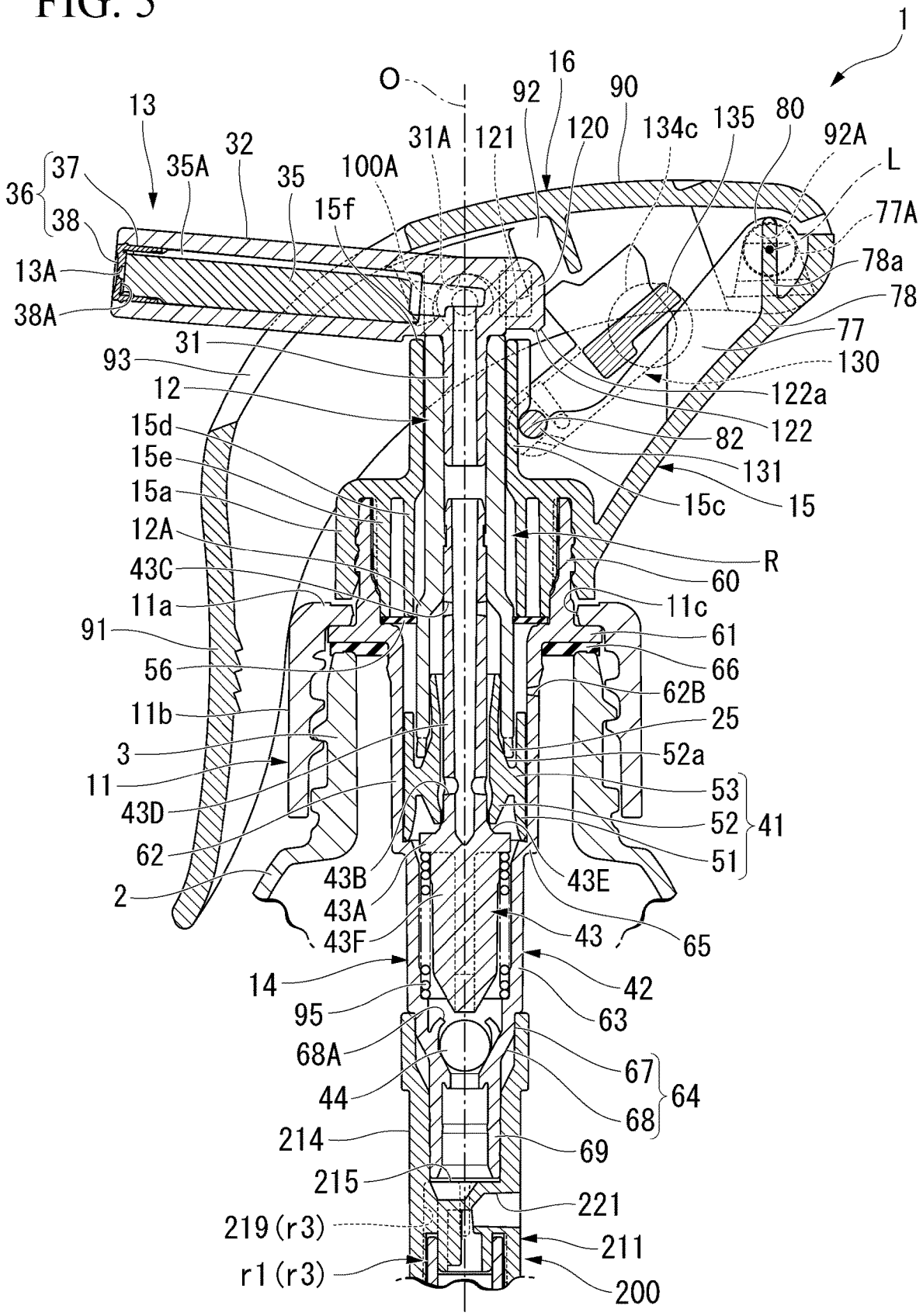
FIG. 5 is a view showing the discharger according to the first embodiment, as a longitudinal sectional view showing a state where a stopper is located at a restriction release position after a state shown in FIG. 2 and a depressing member is rotated downward to depress a discharge head.

The stepped portion 65 faces the outer tube piston 51 of the piston 41 in an up-down direction. As shown in FIG. 5, when the piston 41 is located at a lower end position, a lower end of the outer tube piston 51 comes into contact with an upper surface of the stepped portion 65.

As shown in FIG. 2, an upright tube 60 that extends upward and is inserted into the opening 11*c* of the mounting cap 11 is formed on an upper surface of the support plate 61. The outer diameter and the inner diameter of the upright tube 60 are larger than the outer diameter and the inner diameter of the upper tube 62. An upper end opening edge of the upright tube 60 is located at the same position in an up-down direction as the stepped tube 12A of the stem 12.

An upper surface of the support plate 61 is located at the same position in an up-down direction as an upper end opening edge of the outer tube piston 51 of the piston 41. An annular second packing 56 is disposed integrally with an upper surface of an inner peripheral portion of the support plate 61, located radially inward of the upright tube 60 and an upper end opening edge of the outer tube piston 51.

The small diameter portion 64 includes a straight tube 67 that extends straight downward from a lower end of the lower tube 63, and a tapered tube 68 whose inner and outer diameters gradually decrease as it goes downward from a lower end of the straight tube 67. The valve body 44 is disposed on the inside of the tapered tube 68 so as to be attachable to and detachable from an inner peripheral surface of the tapered tube 68.

Note that, the valve body 44 is a so-called ball valve made of a synthetic resin formed in a spherical shape. Since the valve body 44 is made of a synthetic resin, the cost can be reduced and it is not necessary to separate the valve body 44 at the time of disposal. Further, the valve body 44 may be made of metal or the like. Furthermore, a check valve using various valve bodies instead of a ball valve may be used.

A restriction projection 68A extending gradually upward as it goes from the outside to the inside in a radial direction projects from an inner peripheral surface of the tapered tube 68. The inner diameter of an upper end of the restriction projection 68A is smaller than the outer diameter of the valve body 44. Accordingly, upward separation of the valve body 44 from the restriction projection 68A is restricted. Note that, gaps that divide the extension in the circumferential direction are formed in the restriction projection 68A.

The piston guide 43 penetrates the inside of the piston 41 in an up-down direction. The piston guide 43 is formed in a bottomed tubular shape including a peripheral tube 43D extending downward from the stem 12 and a bottom wall. The bottom wall of the piston guide 43 is located below the inner tube piston 52 of the piston 41. An annular flange 43A protruding outward in a radial direction is formed in the bottom wall.

The contact portion 43E whose outer diameter gradually reduces as it goes upward from an upper surface of the flange 43A is formed at a lower end of the peripheral tube 43D of the piston guide 43. A lower end of the inner tube piston 52 of the piston 41 is in contact with the contact portion 43E.

A communication hole 43B that allows communication between the inside of the piston guide 43 and the inside of the cylinder 42 is formed in the peripheral tube 43D of the piston guide 43. More specifically, a communication hole 43B is formed at a lower portion of the peripheral tube 43D. The communication hole 43B is disposed, for example, on both sides of the peripheral tube with the central axis O interposed therebetween in a radial direction. The communication hole 43B is located above the contact portion 43E with which a lower end of the inner tube piston 52 comes into contact. Accordingly, communication between the communication hole 43B and the inside of the upper tube 62 of the cylinder 42 is blocked.

A through-hole 43C that allows communication between the inside of the piston guide 43 and the inside of the stem 12 is formed in the peripheral tube 43D of the piston guide 43. More specifically, the through-hole 43C is formed at an upper portion of the peripheral tube 43D. Similar to the communication hole 43B, the through-hole 43C is disposed, for example, on both sides of the peripheral tube with the central axis O interposed therebetween in a radial direction. The through-hole 43C is disposed above the communication hole 43B and opens toward an inner peripheral surface of the stepped tube 12A of the stem 12. Since the communication hole 43B and the through-hole 43C are formed in the piston guide 43, it is possible to prevent air from remaining between the piston guide 43 and the piston 41 and between the piston guide 43 and the stem 12.

A portion of the piston guide 43, located above the through-hole 43C is fitted into the stem 12. Accordingly, the piston guide 43 moves up and down together with the stem 12.

A guide projection 43F which protrudes downward and to which a coil spring 95 is externally attached is formed at a lower end of the piston guide 43. The guide projection 43F is configured by disposing a plurality of plates with front and back surfaces thereof facing in the circumferential direction, around the central axis O. The guide projection 43F is disposed from a lower portion of the upper tube 62 to an upper portion of the lower tube 63 of the cylinder 42.

In the coil spring 95, an upper end is in contact with a lower surface of the flange 43A and a lower end is in contact with an upper end opening edge of the straight tube 67 of the cylinder 42. Accordingly, the piston guide 43 receives an upward biasing force from the coil spring 95.

The support portion 15 includes a surrounding tube 15*a* that has a topped tubular shape and is externally attached to the upright tube 60 of the cylinder 42, a guide tube 15*c* that extends upward from a top wall of the surrounding tube 15*a*, a pair of side walls 77 that project rearward from the surrounding tube 15*a* and are disposed with a gap therebetween in a left-right direction, and a rear wall 78 that connects rear edges of the side walls 77 to each other in a left-right direction.

A top wall of the surrounding tube 15*a* is formed in an annular shape, and the guide tube 15*c* is disposed on an inner peripheral edge of this top wall. The stem 12 is inserted into the guide tube 15*c* so as to be movable downward. An inner hanging tube 15*d* into which the stem 12 is inserted and an outer hanging tube 15*e* disposed between the inner hanging tube 15*d* and a peripheral wall of the surrounding tube 15*a* are formed on a lower surface of a top wall of the surrounding tube 15*a*. The guide tube 15*c*, the inner hanging tube 15*d*, and the outer hanging tube 15*e* are disposed coaxially with the central axis O.

A lower end of a peripheral wall of the surrounding tube 15*a* faces the top wall 11*a* of the mounting cap 11 in an up-down direction with a gap interposed therebetween.

The outer hanging tube 15*e* is fitted into the upright tube 60. A lower end opening edge of the outer hanging tube 15*e* is pressed against an upper surface of an inner peripheral portion of the support plate 61 of the cylinder 42 via the second packing 56.

The inner hanging tube 15*d* is externally attached to a lower portion of the stem 12. A lower end opening edge of the inner hanging tube 15*d* is pressed against an upper end opening edge of the outer tube piston 51 of the piston 41 via the second packing 56.

The second packing 56 is externally fitted onto a lower end of the stem 12. The second packing 56 can block communication between the outside air introduction channel R defined between the stem 12 and the guide tube 15*c*, and an upper space, in the cylinder 42, located above the outer tube piston 51 of the piston 41.

The side wall 77 extends gradually upward as it goes from a side in front to a side in rear. A protruding piece 80 formed in a semicircular shape protruding upward in an elevation view as viewed in a left-right direction is formed at an upper end of the side wall 77. A shaft 77A having a circular column shape projects outward in a left-right direction from the protruding piece 80. The shaft 77A is disposed rearward of the stem 12. A virtual axis passing through the center of the shaft 77A and extending in a left-right direction becomes a rotation axis L of the depressing member 16. Accordingly, the rotation axis L is disposed rearward of the stem 12 and extends in a left-right direction.

A reinforcing wall 78*a* which protrudes upward and connects inner surfaces of the pair of side walls 77 and the protruding piece 80 integrally with each other in a left-right direction is formed on an inner surface of the rear wall 78.

The depressing member 16 is attached to the support portion 15 via the shaft 77A. Accordingly, the depressing member 16 is connected to the support portion 15 so to be swingable (rotatable) around the rotation axis L.

The depressing member 16 includes a top plate 90 that covers the discharge head 13 from above, a front plate 91 that extends gradually downward as it goes forward from a front edge of the top plate 90, and a pair of side plates 92 that extend downward from side edges of both left and right sides of the top plate 90 and face each other in a left-right direction.

Then, the discharge head 13 is disposed in an internal space surrounded by the top plate 90 and the pair of side plates 92. The pair of side plates 92 are disposed such that the discharge head 13 is interposed therebetween in a left-right direction.

A lower edge of the side plate 92 has a curved shape protruding upward when viewed in a left-right direction. An upper end of a lower edge of the side plate 92 is located rearward of the central axis O when viewed in a left-right direction.

The top plate 90 has a smoothly curved shape so as to bulge upward, and a rear end thereof is in contact with an upper end of the rear wall 78 of the support portion 15 from above. Accordingly, further upward rotation of the depressing member 16 about the rotation axis L is restricted.

A first through-hole 93 that penetrates the top plate 90 is formed at a front portion of the top plate 90. The first through-hole 93 is formed at a central portion of the top plate 90 in a left-right direction and opens forward. Accordingly, a front portion of the top plate 90 has a bifurcated shape in a left-right direction. The front plate 91 extends gradually downward as it goes forward from a front edge of the bifurcated top plate 90.

The nozzle tube 32 of the discharge head 13 is inserted into the first through-hole 93. Accordingly, the nozzle tube 32 protrudes forward from the front plate 91 through the first through-hole 93, and thus relative rotation between the depressing member 16 and the discharge head 13 around the central axis O is restricted. Note that, a lower portion of the front plate 91 is a finger hook portion to be hooked with a fingertip.

The pair of side plates 92 of the depressing member 16 sandwich upper portions of the pair of side walls 77 of the support portion 15 therebetween in a left-right direction. Accordingly, relative rotation between the support portion 15 and the depressing member 16 around the central axis O is restricted. A shaft hole 92A into which the shaft 77A is inserted is formed on an inner surface on a rear portion side of the pair of side plates 92. Accordingly, the depressing member 16 is supported to be rotatable around the shaft 77A, that is, around the rotation axis L.

An engagement groove 31A that engages with the second locking target portion 100A of the discharge head 13 is formed in the depressing member 16. The engagement groove 31A is formed at a lower end of a plate that overhangs inward in a left-right direction from the pair of side plates 92 of the depressing member 16 in a semicircular shape that opens downward.

The second locking target portion 100A is inserted into the engagement groove 31A.

In the above configuration, when the depressing member 16 is rotated downward around the rotation axis L, an inner peripheral surface of the engagement groove 31A pushes an outer peripheral surface of the second locking target portion 100A downward, thereby the stem 12 and the piston guide 43 descending against the upward force of the coil spring 95.

Furthermore, in the present embodiment, the discharger 1 includes a stopper 130 that restricts downward movement of the discharge head 13.

The stopper 130 is disposed to be swingable in a front-rear direction around a shaft 131 parallel to the rotation axis L of the depressing member 16, and thus can be switched between a restriction position for restricting downward movement of the discharge head 13 (a position shown in FIG. 2) and a restriction release position for allowing the discharge head 13 to move downward by being swung rearward from the restriction position around the shaft 131 (a position shown in FIG. 5).

Note that, a positional relationship between respective portions of the stopper 130 described below is a positional relationship when the stopper 130 is located at the restriction position.

Figure 6:
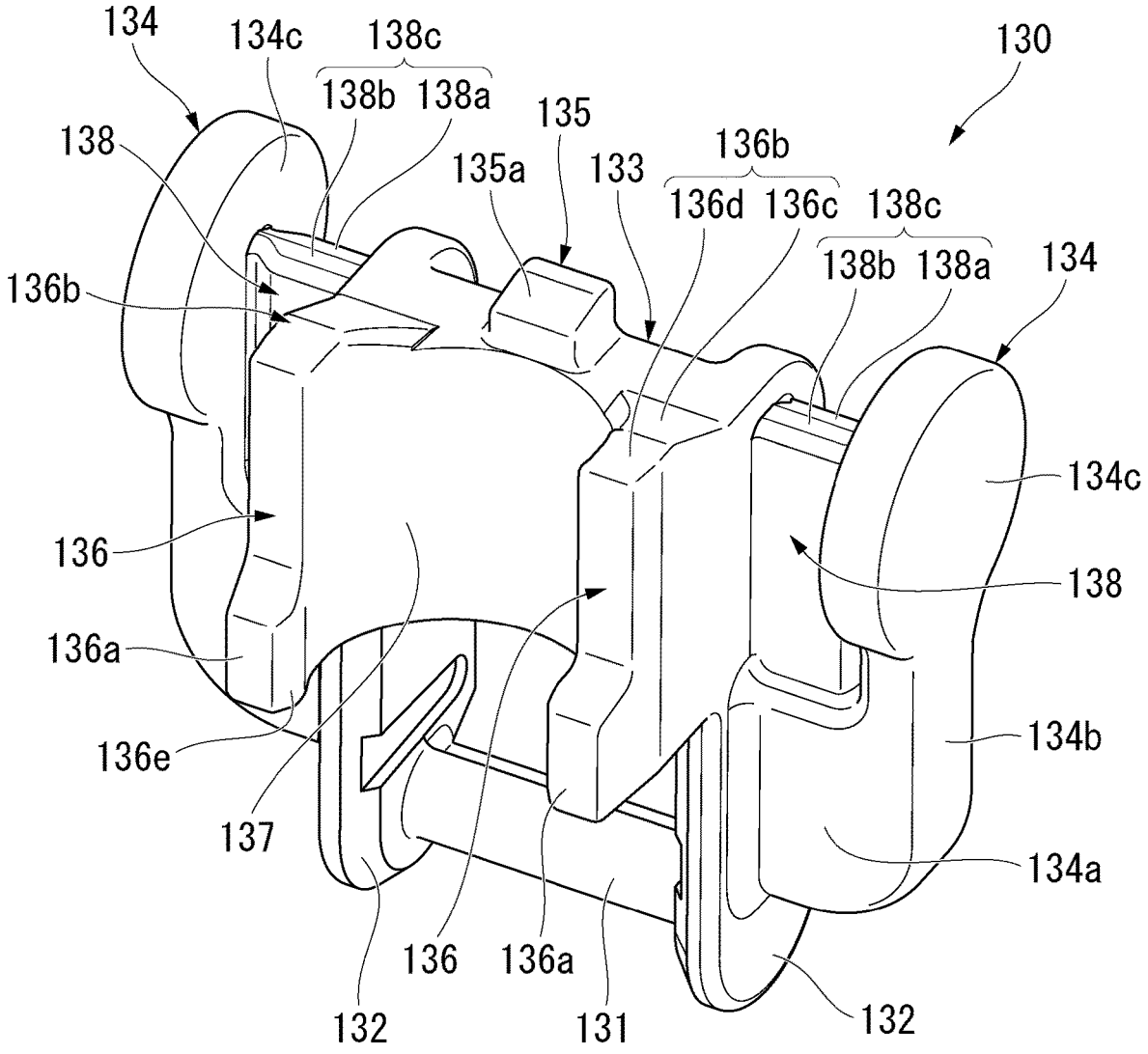
FIG. 6 is a perspective view showing a stopper of the discharger according to the first embodiment.

As shown in FIG. 6, the stopper 130 includes a pair of stopper side walls 132 that are disposed with a gap therebetween in a left-right direction, a connection wall 133 that connects the pair of stopper side walls 132 to each other, a shaft 131 that is disposed below the connection wall 133 and connects the pair of stopper side walls 132 to each other, a first restriction portion 135 that protrudes upward from the connection wall 133, a pair of left and right second restriction portions 136 that protrude forward from at least one of the stopper side wall 132 and the connection wall 133, a knob 134 that protrudes outward from each of the pair of stopper side walls 132 in a left-right direction and has a finger hook 134*c* located outward from the depressing member 16 in a left-right direction, and a contact target portion 138 that comes into contact with the depressing member 16 when the stopper 130 comes into contact with the depressing member 16 in a state where the stopper is located at the restriction position, or the depressing member 16 rotates downward around the rotation axis L in a state where the stopper 130 is located at the restriction position.

The pair of stopper side walls 132 are formed in a plate shape with front and back surfaces thereof facing in a left-right direction and have a rectangular shape which is long in an up-down direction when viewed in a left-right direction.

The connection wall 133 is formed in a plate shape with front and back surfaces thereof facing in a front-rear direction and has a rectangular shape in which a pair of sides extend in a left-right direction and a remaining pair of sides extend in an up-down direction, when viewed in a front-rear direction. An upper end surface of the connection wall 133 is flush with an upper end surface of the stopper side wall 132. A lower end of the connection wall 133 is located above a lower end of the stopper side wall 132.

The shaft 131 is formed in a round bar shape extending in a left-right direction. The shaft 131 connects lower ends of the pair of stopper side walls 132 to each other. As shown in FIG. 2, the shaft 131 is fitted into a second support recess 82 formed in the pair of side walls 77 of the support portion 15 so as to be rotatable around a central axis. The second support recess 82 is disposed rearward of the stem 12. The stopper 130 is attached to the support portion 15 so as to be swingable in a front-rear direction around the shaft 131 in a side behind the stem 12.

The first restriction portion 135 has a substantially rectangular parallelepiped shape. The first restriction portion 135 extends upward from an upper end surface of the connection wall 133. The first restriction portion 135 is located at the center of the connection wall 133 in a left-right direction. A dimension of the first restriction portion 135 in a left-right direction is smaller than a dimension of the connection wall 133 in a left-right direction. A dimension of the first restriction portion 135 in a front-rear direction is substantially the same as a dimension of the connection wall 133 in a front-rear direction. In an upper end surface of the first restriction portion 135, at a front portion located forward of a rear end, an inclined surface 135*a* extending downward as it goes forward is formed.

When the stopper 130 is located at the restriction position shown in FIG. 2, the first restriction portion 135 comes into contact with or approaches the first locking target portion 120 of the discharge head 13 from below the first locking target portion 120. When the stopper 130 is located at the restriction position, an upper end of the first restriction portion 135 engages with the engagement projection 122 from a side in front of the engagement projection 122. When the stopper 130 is located at the restriction position, the first restriction portion 135 comes into contact with or approaches a lower surface of the first locking target portion 120, and a lower end surface of the connection wall 133 comes into contact with or approaches an upper end opening edge 15*f* of the guide tube 15*c*.

When the stopper 130 is located at the restriction release position shown in FIG. 5, the first restriction portion 135 is separated rearward from the first locking target portion 120.

As shown in FIG. 6, the second restriction portion 136 protrudes forward integrally from an end of the connection wall 133 in a left-right direction and the stopper side wall 132. The second restriction portion 136 is formed in a plate shape with front and back surfaces thereof facing in a left-right direction. In the second restriction portion 136, a lower end 136*a* protrudes more forward than an upper portion located above the lower end 136*a*. In an upper end surface 136*b* of the second restriction portion 136, a rear portion 136*c* is an inclined surface extending gradually upward as it goes forward and a front portion 136*d* is a flat surface orthogonal to an up-down direction. A rear edge of the upper end surface 136*b* of the second restriction portion 136 is connected to an upper end surface of the connection wall 133 without any step.

Positions of the front portion 136*d* of the upper end surface 136*b* of the second restriction portion 136 and a rear end of an upper end surface of the first restriction portion 135 in an up-down direction are the same as each other.

A concave curved fitting surface 137 having a C-shape opening forward when viewed in an up-down direction is formed integrally with inner surfaces of the pair of second restriction portions 136, facing each other in a left-right direction, and a portion of a front surface of the connection wall 133, located between the pair of second restriction portions 136. A radius of the fitting surface 137 is substantially the same as a radius of an outer peripheral surface of the stem 12. When the stopper 130 is located at the restriction position shown in FIG. 2, the fitting surface 137 is disposed coaxially with the central axis O and is externally fitted onto the stein 12 from a side behind the stem 12.

A bulge portion 136*e* that bulges inward in a left-right direction is formed at a front end of the lower end 136*a* of the second restriction portion 136. A gap between a pair of the bulge portions 136*e* in a left-right direction is smaller than the outer diameter of the stem 12.

Accordingly, when the fitting surface 137 is externally fitted onto the stem 12 and when the fitting surface 137 is removed from the stem 12, the bulge portion 136*e* of the second restriction portion 136 slidably comes into contact with an outer peripheral surface of the stem 12, and thus, the lower ends 136*a* of the pair of second restriction portions 136 are elastically deformed and expanded outward in a left-right direction.

When the stopper 130 is located at the restriction position shown in FIG. 2, the second restriction portion 136 comes into contact with or approaches the second locking target portion 100A from below the second locking target portion 100A. More specifically, as shown in FIG. 3, when the stopper 130 is located at the restriction position, the front portion 136*d* of the upper end surface 136*b* of the second restriction portion 136 comes into contact with or approaches the flat surface 100A1 of the second locking target portion 100A from below. At this time, a lower end surface of the second restriction portion 136 comes into contact with or approaches the upper end opening edge 15*f* of the guide tube 15*c*.

When the stopper 130 is located at the restriction release position shown in FIG. 5, the second restriction portion 136 is separated rearward from the second locking target portion 100A.

As described above, the stopper 130 is disposed to be swingable between the restriction position where the first restriction portion 135 and the second restriction portion 136 come into contact with or approach the first locking target portion 120 and the second locking target portion 100A respectively to restrict downward movement of the discharge head 13 and the restriction release position where the first restriction portion 135 and the second restriction portion 136 are separated from the first locking target portion 120 and the second locking target portion 100A respectively to allow downward movement of the discharge head 13 by the stopper 130 being swung rearward from the restriction position.

In the illustrated example, even if a large force for rotating the depressing member 16 downward around the rotation axis L is applied to the depressing member 16 in a state where the stopper 130 is located at the restriction position, a force for swinging the stopper 130 rearward around the shaft 131 is not applied to the first restriction portion 135 and the second restriction portion 136 from the first locking target portion 120 and the second locking target portion 100A.

As shown in FIG. 6, the knob 134 has a first arm 134*a* extending outward from the stopper side wall 132 in a left-right direction, a second arm 134*b* extending upward from an outer end of the first arm 134*a* in a left-right direction, and a finger hook 134*c* protruding upward from an upper end of the second arm 134*b*.

Figure 4:
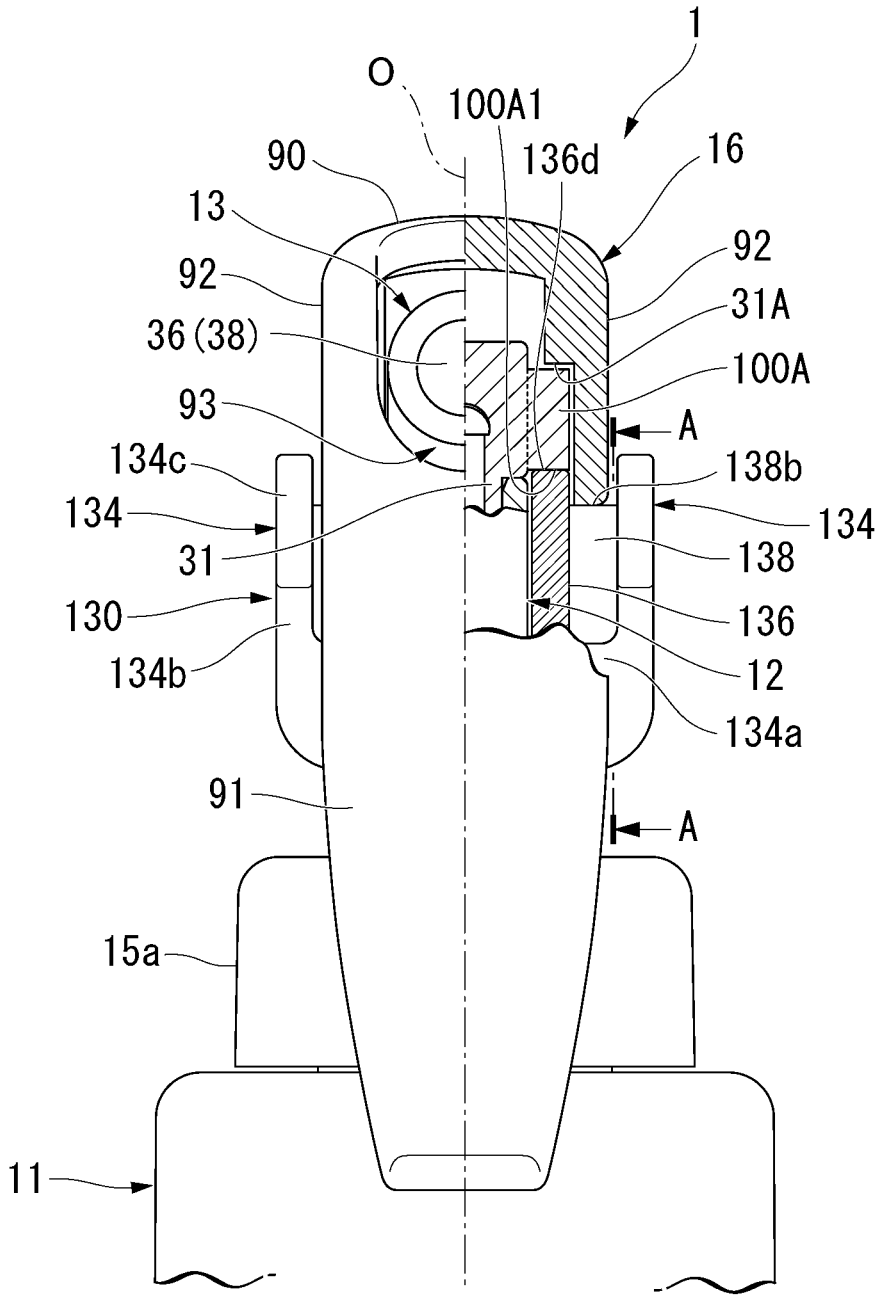
FIG. 4 is a partial sectional view of the discharger shown in FIG. 1, viewed from a side in front.

As shown in FIG. 4, an outer end of the first arm 134*a* in a left-right direction is located outward from the depressing member 16 (side plate 92) in a left-right direction. Accordingly, the second arm 134*b* and the finger hook 134*c* are located outward from the depressing member 16 (side plate 92) in a left-right direction. A shape of the finger hook 134*c* in an elevation view as viewed in a left-right direction is substantially circular. The center of each of the finger hook 134*c* and the second arm 134*b* in a front-rear direction is located at the same position in a front-rear direction. The outer diameter of the finger hook 134*c* is larger than a dimension of the second arm 134*b* in a front-rear direction.

Figure 7:
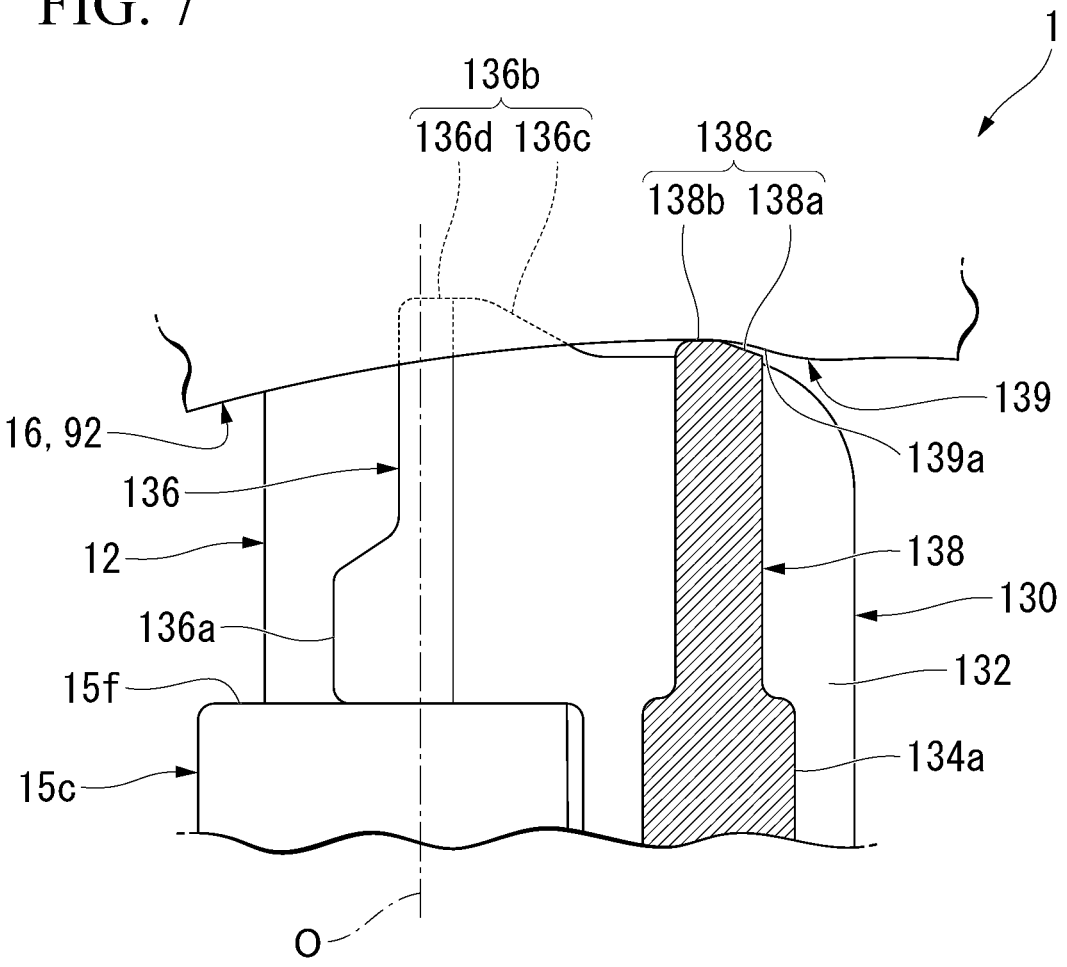
FIG. 7 is a sectional view along line A-A of FIG. 4.

As shown in FIGS. 4, 6, and 7, the contact target portion 138 is disposed between the stopper side wall 132 and the knob 134 and faces a downward lower edge of the side plate 92 of the depressing member 16 from below the depressing member 16. In the illustrated example, an upper end surface 138*c* of the contact target portion 138 is in contact with or approaches a lower edge of the side plate 92 of the depressing member 16. The contact target portion 138 is located rearward of the central axis O.

In the illustrated example, when a large force for rotating the depressing member 16 downward around the rotation axis L is applied to the depressing member 16 in a state where the stopper 130 is located at the restriction position, a force for swinging the stopper 130 rearward around the shaft 131 is applied to the contact target portion 138 from the side plate 92 of the depressing member 16.

The contact target portion 138 is formed in a plate shape with front and back surfaces thereof facing in a front-rear direction and has a rectangular shape long in an up-down direction when viewed in a front-rear direction. The contact target portion 138 is integrally connected to an outer surface of the stopper side wall 132, facing outward in a left-right direction, an upper surface of the first arm 134*a* of the knob 134, an inner surface of the second arm 134*b* of the knob 134, facing inward in a left-right direction, and an inner surface of the finger hook 134*c* of the knob 134, facing inward in a left-right direction. The thickness (size in a front-rear direction) of the contact target portion 138 is smaller than the thickness of each of the first arm 134*a* and the second arm 134*b*. The contact target portion 138 is disposed at the center of each of the stopper side wall 132 and the knob 134 in a front-rear direction.

At least a rear end part of the upper end surface 138*c* of the contact target portion 138 extends gradually downward as it goes rearward. According to the illustrated example, in the upper end surface 138*c* of the contact target portion 138, a rear portion 138*a* is an inclined surface extending gradually downward as it goes rearward and a front portion 138*b* is a flat surface orthogonal to an up-down direction. In the upper end surface 138*c* of the contact target portion 138, the front portion 138*b* is in contact with or approaches a lower edge of the side plate 92 of the depressing member 16. A front edge of the upper end surface 138*c* of the contact target portion 138 is formed in a curved shape with rounded corners.

Then, in the present embodiment, as shown in FIG. 7, a restraint protrusion 139 protruding downward is formed at a portion of the depressing member 16, located rearward of a contact portion with which the contact target portion 138 of the stopper 130 comes into contact.

In the illustrated example, the restraint protrusion 139 is formed at a lower edge of the side plate 92 of the depressing member 16. The restraint protrusion 139 is formed at an upper end of a lower edge of the side plate 92, located rearward of the central axis O. The restraint protrusion 139 approaches the contact target portion 138 from a side behind the contact target portion 138. The restraint protrusion 139 is formed in a curved shape protruding downward. The size of the restraint protrusion 139 in a front-rear direction is larger than the size of the contact target portion 138 in a front-rear direction. Note that, the size of the restraint protrusion 139 in a front-rear direction may be equal to or smaller than the size of the contact target portion 138 in a front-rear direction.

At least a part of the restraint protrusion 139 faces a rear end part of the upper end surface 138*c* of the contact target portion 138 in an up-down direction, in a state where the stopper 130 is located at the restriction position. In the illustrated example, a front end 139*a* of the restraint protrusion 139, extending gradually downward as it goes rearward from a side in front, and the rear portion 138*a* of the upper end surface 138*c* of the contact target portion 138 face each other in an up-down direction. Positions of a lower end of the restraint protrusion 139 and a rear end of the upper end surface 138*c* of the contact target portion 138 in an up-down direction are the same as each other. The lowest portion of the restraint protrusion 139 is located rearward of the upper end surface 138*c* of the contact target portion 138.

Figure 8:
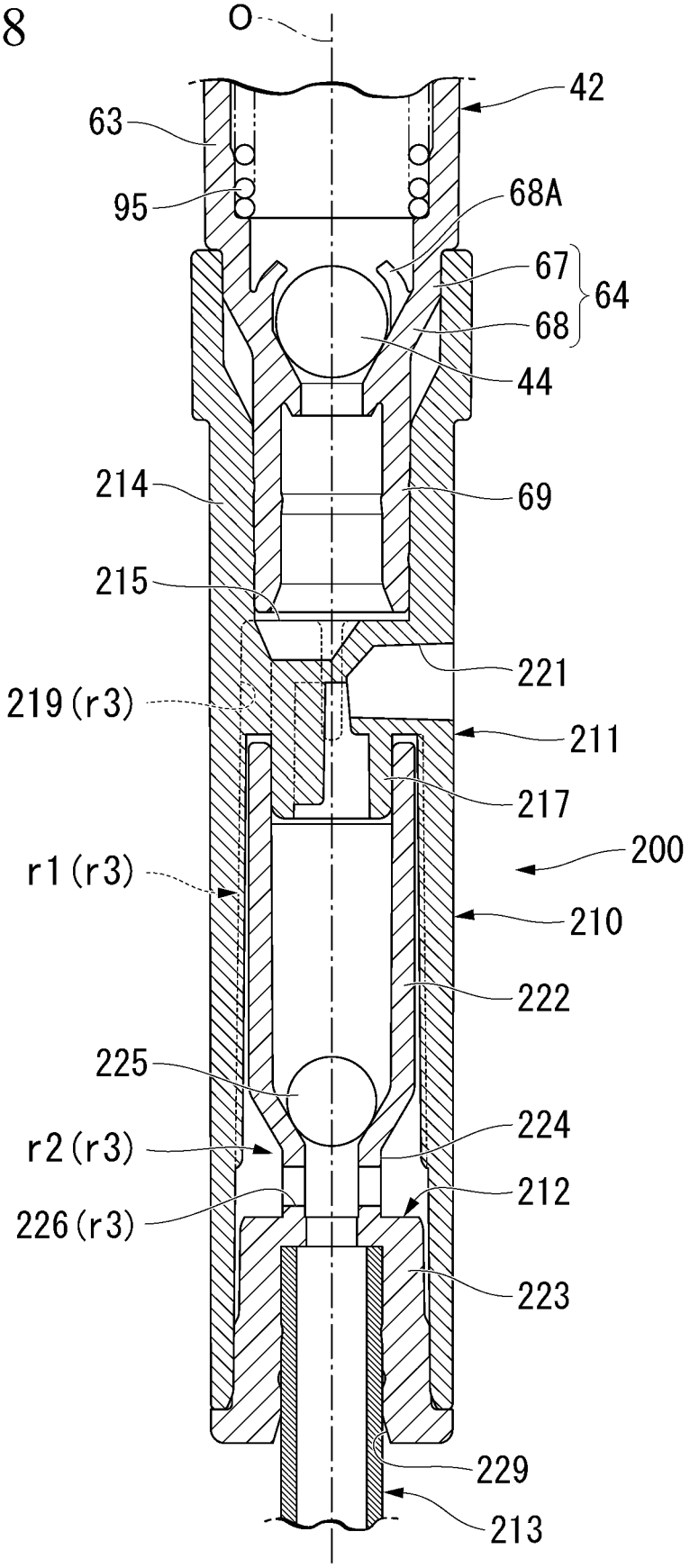
FIG. 8 is a longitudinal sectional view showing a lower half of the discharger shown in FIG. 1.
Figure 9:
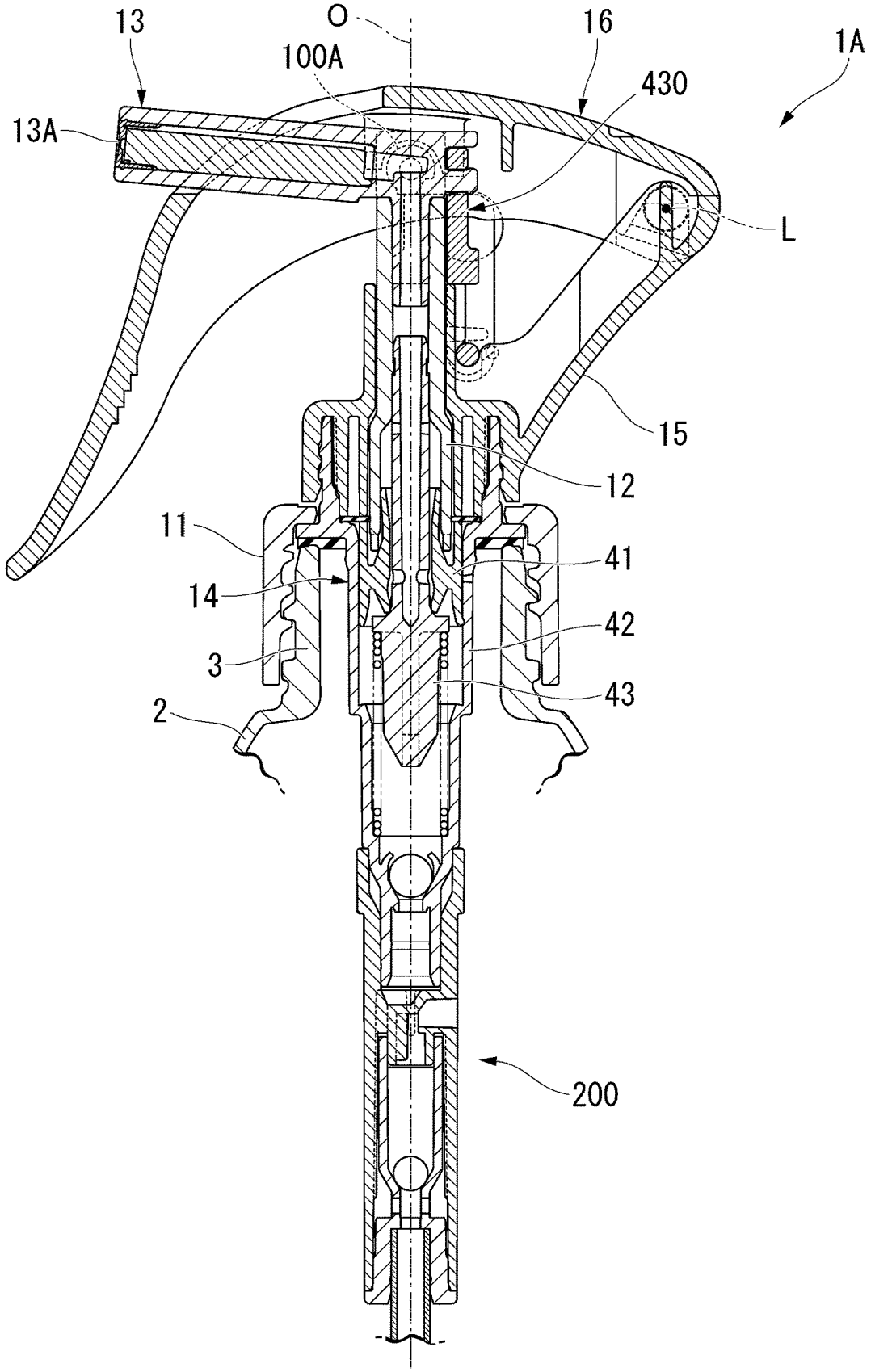
FIG. 9 is a longitudinal sectional view of a discharger according to a second embodiment of the present invention in which an invertible adapter is mounted and a stopper is located at a restriction position, viewed in a left-right direction along an axial direction.

As shown in FIG. 8, the invertible adapter 200 includes a cylindrical main body tube 210. The main body tube 210 is disposed coaxially with the central axis O. The main body tube 210 includes a cylindrical outer tube member 211 externally fitted onto the cylinder 42 and an inner tube member 212 fitted into the outer tube member 211. An upper end of a cylindrical pipe 213 whose lower end opening opens toward the inside of the container body 2 is fitted into a lower end of the inner tube member 212. The outer tube member 211, the inner tube member 212, and the pipe 213 are disposed coaxially with the central axis O.

The outer tube member 211 includes a cylindrical outer tube 214 having an upper end into which the straight tube 67 of the cylinder 42 is fitted, a partitioning wall 215 that is disposed at an intermediate portion of the outer tube 214 in an up-down direction to partition the inside of the outer tube 214 into an upper part and a lower part, and a cylindrical connection tube 217 which extends downward from the partitioning wall 215 and to which an upper end of the inner tube member 212 is connected.

In the partitioning wall 215, a liquid passage hole 219 is formed which penetrates the partitioning wall in an up-down direction. In an upper end of the connection tube 217, a part of an outer peripheral surface is connected to an inner peripheral surface of the outer tube 214, and the other portion of an outer peripheral surface is separated radially inward from an inner peripheral surface of the outer tube 214. Then, in the outer tube member 211, an introduction hole 221 at the time of inversion is formed which penetrates the part of the connection tube 217 and the outer tube 214 integrally in a radial direction. The introduction hole 221 at the time of inversion is provided so that the liquid content in the container body 2 can be introduced into the connection tube 217 when the discharger 1 is inverted.

The inner tube member 212 includes a cylindrical upper tube 222 having an upper end connected to the connection tube 217, a cylindrical lower tube 223 that is disposed below the upper tube 222 and has a lower end located below a lower end of the outer tube member 211, and a cylindrical coupling tube 224 that couples the upper tube 222 and the lower tube 223.

An upper end of the upper tube 222 is externally fitted onto the connection tube 217. Then, a first flow channel r1 through which the liquid content flows is formed between an outer peripheral surface of the upper tube 222 and an inner peripheral surface of the outer tube 214. The first flow channel r1 communicates with the liquid passage hole 219. A lower end of the upper tube 222 has a tapered shape in which the inner diameter and the outer diameter gradually decrease as it goes downward. A spherical switching valve 225 is disposed in a lower end of the upper tube 222 so as to be separated upward.

The switching valve 225 is formed of a metal material.

A second flow channel r2 through which the liquid content flows is formed between an outer peripheral surface of the coupling tube 224 and an inner peripheral surface of the outer tube 214. The second flow channel r2 communicates with the first flow channel r1. The coupling tube 224 has a communication hole 226 through which the inside of the coupling tube communicates with the second flow channel r2. A plurality of the communication holes 226 are formed in the coupling tube 224 at intervals in the circumferential direction.

Here, the communication hole 226, the second flow channel r2, the first flow channel r1, and the liquid passage hole 219 constitute a communication channel r3 through which an introduction hole 229 at the time of erection in a lower end of the inner tube member 212 and the introduction hole 221 at the time of inversion communicate with a lower end opening of the connection tube 69 of the cylinder 42. The introduction hole 229 at the time of erection is disposed below the introduction hole 221 at the time of inversion.

The lower tube 223 is fitted into a lower end of the outer tube member 211. An upper end of the pipe 213 is fitted in the lower tube 223, and a lower end opening of the pipe 213 opens toward a bottom in the container body 2. A lower end opening of the pipe 213 and the introduction hole 229 at the time of erection are provided so that the liquid content in the container body 2 can be introduced into the inner tube member 212 when the discharger 1 is erected. The liquid content is introduced into the introduction hole 229 at the time of erection through the pipe 213.

Next, a method of using the discharger 1 configured as described above will be described.

When using the discharger 1, first, the stopper 130 is swung from the restriction position to the restriction release position on a side in rear so that the depressing member 16 and the discharge head 13 can move downward. Next, the depressing member 16 is rotated downward around the rotation axis L. At this time, for example, while hooking a fingertip on the finger hook portion of the front plate 91 of the depressing member 16, the depressing member 16 is rotated downward against a biasing force of the coil spring 95. When the depressing member 16 is rotated downward, the discharge head 13 moves downward, and the stem 12 and the piston guide 43 are depressed with respect to the cylinder 42 in a state where the valve body 44 closes the tapered tube 68 of the cylinder 42.

When the stem 12 is depressed together with the piston guide 43, the depressing force applied to the stem 12 is transmitted to the piston 41 via the elastic piece 25, and the piston 41 is integrated with the stem 12 and the piston guide 43 to move downward with respect to the cylinder 42. Accordingly, the inside of the cylinder 42 is pressurized in a state where a lower end of the inner tube piston 52 of the piston 41 blocks the communication between the inside of the stem 12 and the inside of the cylinder 42. When the stem 12 is further depressed in this state, downward movement of the piston 41 is suppressed by the increased internal pressure of the cylinder 42, and the stem 12 and the piston guide 43 move downward with respect to the piston 41.

For this reason, the stem 12 and the piston guide 43 move downward with respect to the piston 41 while elastically deforming the elastic piece 25 by applying a compression force in an up-down direction to the elastic piece 25 disposed between the stem 12 and the piston 41. At this time, a lower end of the inner tube piston 52 of the piston 41 is separated upward from the contact portion 43E of the piston guide 43, and a gap in a radial direction is formed between a lower end of the inner tube piston 52 and an outer peripheral surface of the piston guide 43. Therefore, the communication hole 43B is opened with respect to the inside of the cylinder 42 through this gap. Note that, the internal pressure of the cylinder 42 is further increased until the communication hole 43B is opened with respect to the inside of the cylinder 42.

Accordingly, the liquid content in the cylinder 42 flows into the piston guide 43 through the gap between an inner peripheral surface of the inner tube piston 52 and an outer peripheral surface of the piston guide 43 and through the communication hole 43B. Then, the liquid content flowing into the piston guide 43 flows in an upper portion of the stem 12 and reaches the nozzle tube 32, and is discharged from the discharge hole 13A of the nozzle tube 32. As a result, the liquid content accommodated in the container body 2 can be discharged to the outside through the discharge hole 13A.

Thereafter, when an operation of the depressing member 16 is released, the stem 12 and the piston 41 move to restore with respect to the cylinder 42 based on a biasing force from the coil spring 95. At this time, a negative pressure is generated in the cylinder 42, and this negative pressure acts on the valve body 44 to open the inside of the tapered tube 68 and acts on the switching valve 225 shown in FIG. 8 through the communication channel r3. Then, when the discharger 1 is erected, the switching valve 225 maintains a state where the communication between the introduction hole 221 at the time of inversion and the communication channel r3 is blocked. As a result, the liquid content in the container body 2 reaches a lower end opening of the cylinder 42 through the introduction hole 229 at the time of erection, the inside of the main body tube 210, and the communication channel r3, and flows into the cylinder 42.

On the other hand, when the discharger 1 is inverted, a lower end opening of the pipe 213 that opens to a bottom in the container body 2 protrudes from a liquid level of the liquid content in the container main body 2. In addition, in a state where the introduction hole 221 at the time of inversion is located within the liquid content in the container body 2, the switching valve 225 is separated from an inner peripheral surface of a lower end of the upper tube 222 by own weight thereof, and the introduction hole 221 at the time of inversion and the communication channel r3 communicate with each other through the inside of the main body tube 210. Therefore, when a negative pressure is generated in the cylinder 42, the liquid content in the container body 2 reaches a lower end opening of the cylinder 42 through the introduction hole 221 at the time of inversion, the inside of the main body tube 210, and the communication channel r3, and flows into the cylinder 42.

In any case where the discharger 1 is erected or inverted, when the discharge head 13, the stem 12, and the piston 41 are integrally depressed with respect to the cylinder 42, a lower space, in the cylinder 42, located below the piston 41 is pressurized and the liquid content in the lower space rises in the stem 12 and is discharged from the discharge hole 13A. In this process, the second packing 56 opens a lower end opening of an outside air introduction channel R, the outside air introduction channel R communicates with the upper space in the cylinder 42, and outside air is introduced into the upper space in the cylinder 42.

When the discharge head 13, the stem 12, and the piston 41 are released from being depressed and are displaced to restore upward, a negative pressure is generated in the lower space in the cylinder 42, and the liquid content in the container body 2 is introduced into the lower space in the cylinder 42. In this process, the air in the upper space is introduced into the container body 2 due to the communication between the upper space in the cylinder 42 and the inside of the container body 2 through the air hole 62B.

Thereafter, when the stem 12 and the piston 41 return to an original state, the communication between the outside air introduction channel R and the upper space in the cylinder 42 is blocked by the second packing 56, and communication between the inside of the container body 2 and the outside through the outside air introduction channel R is blocked.

Note that, since the second packing 56 is disposed to block the communication between the outside air introduction channel R and the upper space in the cylinder 42, even if the discharger 1 is inverted and thus the liquid content in the container body 2 reaches the upper space in the cylinder 42, it is possible to prevent this liquid content from leaking outside through the outside air introduction channel R.

As described above, according to the discharger 1 related to the present embodiment, since the restraint protrusion 139 is formed in the depressing member 16, for example, when a large force for rotating the depressing member 16 downward around the rotation axis L is applied to the depressing member 16 in a state where the stopper 130 is located at the restriction position, even if a force directed rearward is applied to the contact target portion 138 of the stopper 130 from the depressing member 16 and thus the stopper 130 is shifted toward the restriction release position, the contact target portion 138 of the stopper 130 comes into contact with the restraint protrusion 139 from a side behind the contact target portion 138, so that the stopper 130 is locked to the restraint protrusion 139. Accordingly, it is possible to inhibit the stopper 130 located at the restriction position from being unexpectedly shifted toward the restriction release position.

Since at least a rear end part of the upper end surface 138*c* of the contact target portion 138 extends gradually downward as it goes rearward, when the large force described above is applied to the depressing member 16, even if the stopper 130 is shifted from the restriction position toward the restriction release position, a force directed forward from the restraint protrusion 139 of the depressing member 16 is applied to the upper end surface 138*c* of the contact target portion 138, so that it is possible for the stopper 130 to be returned to or kept at the restriction position.

Further, since at least a rear end part of the upper end surface 138*c* of the contact target portion 138 extends gradually downward as it goes rearward, as described above, when the stopper 130 is shifted from the restriction position toward the restriction release position, the upper end surface 138*c* of the contact target portion 138 is likely to contact the restraint protrusion 139 and a force directed downward which is applied to the upper end surface 138*c* of the contact target portion 138 from the restraint protrusion 139 is likely to be converted into a force directed forward.

Since at least a part of the restraint protrusion 139 faces a rear end part of the upper end surface 138*c* of the contact target portion 138 in an up-down direction in a state where the stopper 130 is located at the restriction position, it is possible to reduce a distance between the upper end surface 138*c* of the contact target portion 138 and the restraint protrusion 139 in a front-rear direction, so that, when the large force described above is applied to the depressing member 16, it is possible to reliably suppress that the stopper 130 is shifted from the restriction position to the restriction release position and to effectively apply a force directed forward from the restraint protrusion 139 of the depressing member 16 to the upper end surface 138*c* of the contact target portion 138.

Furthermore, when the large force described above is applied to the depressing member 16, if a force directed forward from the restraint protrusion 139 of the depressing member 16 is applied to the upper end surface 138*c* of the contact target portion 138 of the stopper 130, the fitting surface 137 of the stopper 130 is pressed forward against an outer peripheral surface of the stem 12 and the stopper 130 is compressed in an up-down direction by the upper end opening edge 15*f* of the guide tube 15*c* and a lower edge of the side plate 92 of the depressing member 16, so that it is possible to reliably suppress that the stopper 130 is shifted from the restriction position to the restriction release position on a side in rear.

Second Embodiment

Next, a discharger 1A according to a second embodiment of the present invention will be described. In the following description, the same configuration elements as those in the first embodiment described above are denoted by the same reference numerals, and description thereof will be omitted as appropriate. Further, in the description of the second embodiment, the drawings used in the description of the first embodiment may be referred to.

As shown in FIGS. 9 to 13, the discharge head 13 of the discharger 1A according to the present embodiment includes the mounting tube 31 that has a topped tubular shape and is mounted on an upper end of the stem 12, and the nozzle tube 32 that has a tubular shape and protrudes forward from the mounting tube 31.

The mounting tube 31 is fitted into the stem 12. A protruding portion 419 that protrudes rearward is formed at an upper end of the mounting tube 31. A first locking target portion 420 is formed at a portion of an upper end of the mounting tube 31, located below the protruding portion 419.

Engagement projections 422*a* and 422*b* for preventing a later-described stopper 430 from moving from a restriction position to a restriction release position are formed at a rear end of the first locking target portion 420. The engagement projection 422*a* projects upward from the first locking target portion 420. The engagement projection 422*b* projects downward from the first locking target portion 420. Each of the engagement projections 422*a* and 422*b* is formed in a shape in which an amount of projection from the first locking target portion 420 increases toward the center from both sides in a front-rear direction.

Furthermore, in the present embodiment, the discharger 1A includes a stopper 430 that restricts downward movement of the discharge head 13.

Figure 13:
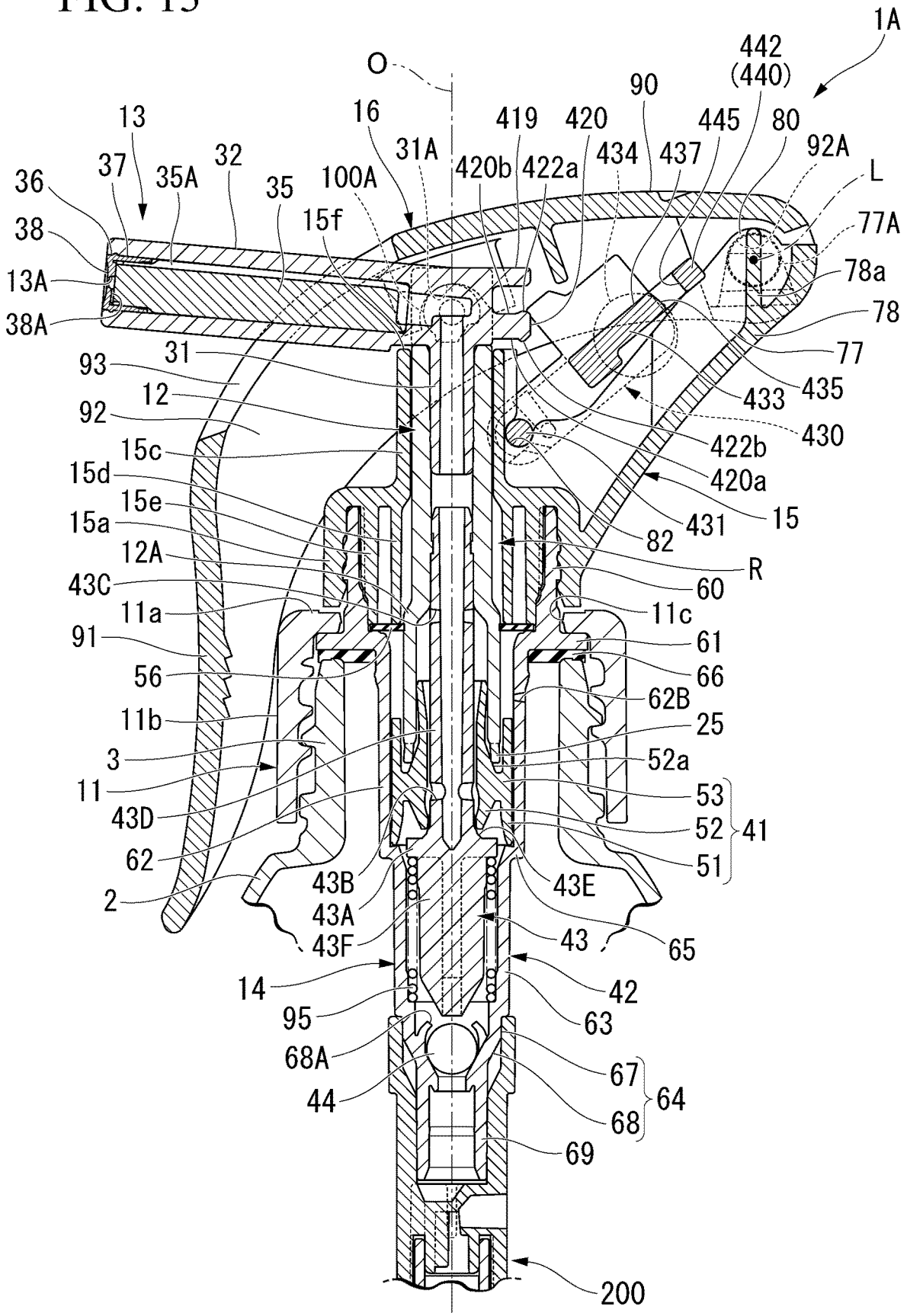
FIG. 13 is a view showing the discharger according to the second embodiment, as a longitudinal sectional view showing a state where a stopper is located at a restriction release position from a state shown in FIG. 10 and a depressing member is rotated downward to depress a discharge head.

The stopper 430 is disposed to be swingable in a front-rear direction around a shaft 431 parallel to the rotation axis L of the depressing member 16, and thus can be switched between the restriction position for restricting downward movement of the discharge head 13 (a position shown in FIG. 10) and the restriction release position for allowing the discharge head 13 to move downward by being swung rearward from the restriction position around the shaft 431 (a position shown in FIG. 13).

Note that, a positional relationship between respective portions of the stopper 430 described below is a positional relationship when the stopper 430 is located at the restriction position.

Figure 14:
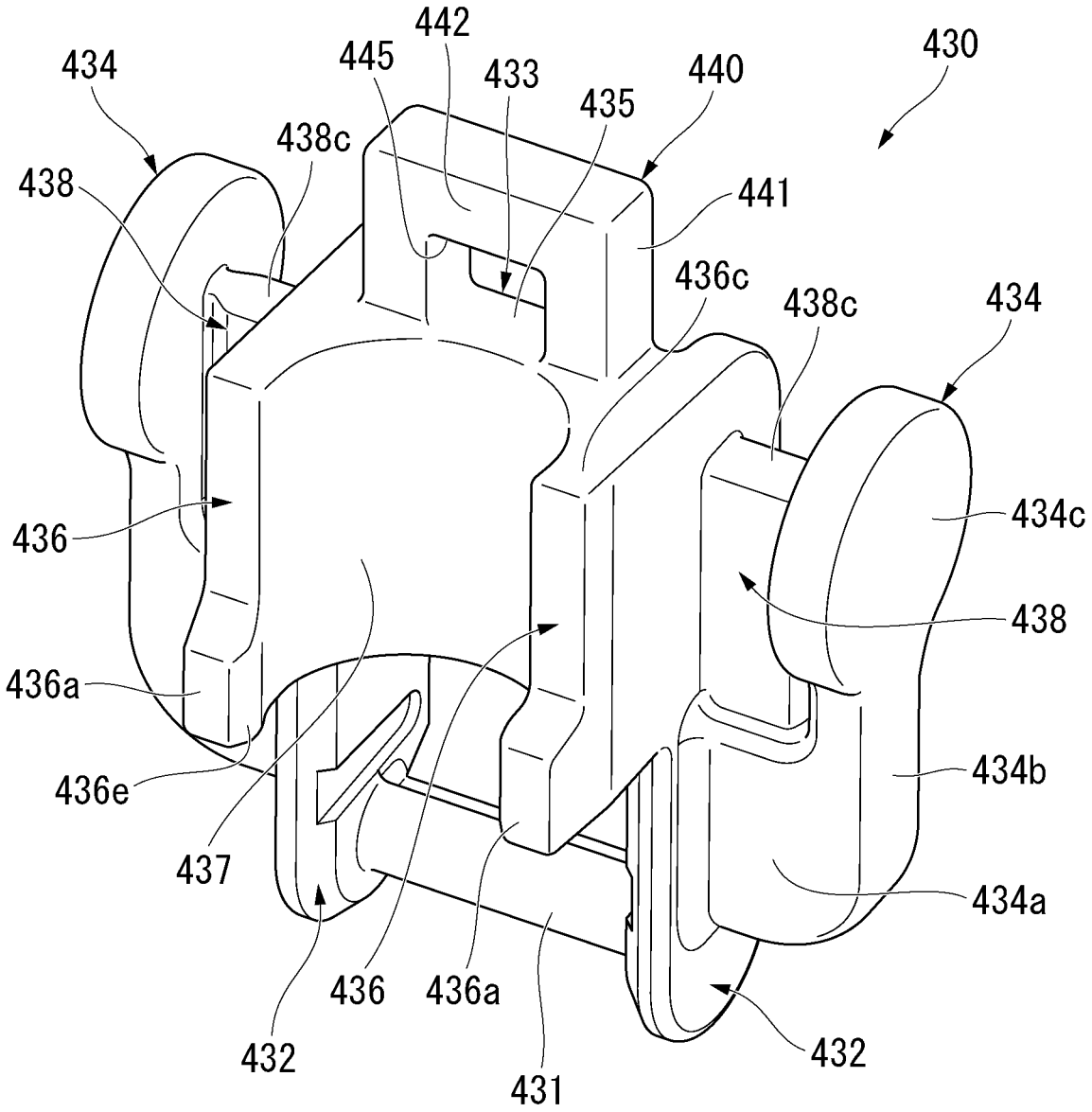
FIG. 14 is a perspective view showing a stopper of the discharger according to the second embodiment.

As shown in FIG. 14, the stopper 430 includes a pair of stopper side walls 432 that are disposed with a gap therebetween in a left-right direction, a connection wall 433 that connects the pair of stopper side walls 432 to each other, a shaft 431 that is disposed below the connection wall 433 and connects the pair of stopper side walls 432 to each other, a pair of left and right restriction portions 436 that protrude forward from at least one of the stopper side wall 432 and the connection wall 433, a knob 434 that protrudes outward from each of the pair of stopper side walls 432 in a left-right direction and has a finger hook 434*c* located outward from the depressing member 16 in a left-right direction, and a contact target portion 438 that comes into contact with the depressing member 16 when the stopper 430 comes into contact with the depressing member 16 in a state where the stopper is located at the restriction position, or the depressing member 16 rotates downward around the rotation axis L in a state where the stopper 430 is located at the restriction position.

The pair of stopper side walls 432 are formed in a plate shape with front and back surfaces thereof facing in a left-right direction and has a rectangular shape long in an up-down direction when viewed in a left-right direction.

The connection wall 433 is formed in a plate shape with front and back surfaces thereof facing in a front-rear direction and has a rectangular shape in which a pair of sides extend in a left-right direction and a remaining pair of sides extend in an up-down direction, when viewed in a front-rear direction. In an upper end surface of the connection wall 433, a portion located at the center in a left-right direction forms a first descending restriction portion 435. In the present embodiment, the first descending restriction portion 435 is an inclined surface that extends upward as it goes rearward.

When the stopper 430 is located at the restriction position shown in FIG. 10, the first descending restriction portion 435 comes into contact with or approaches a lower surface (hereinafter, referred to as a descending locking portion 420*a*) of the first locking target portion 420 of the discharge head 13 from below the first locking target portion 420. When the stopper 430 is located at the restriction position, a rear end of the first descending restriction portion 435 engages with the engagement projection 422*b* from a side in front of the engagement projection 422*b*. When the stopper 430 is located at the restriction position, the first descending restriction portion 435 comes into contact with or approaches the descending locking portion 420*a*, and a lower end surface of the connection wall 433 comes into contact with or approaches the upper end opening edge 15*f* of the guide tube 15*c* from above.

When the stopper 430 is located at the restriction release position shown in FIG. 13, the first descending restriction portion 435 is separated rearward from the first locking target portion 420.

As shown in FIG. 14, in an upper end surface of the connection wall 433, portions located on both sides in a left-right direction are flush with an upper end surface of the stopper side wall 432. A lower end of the connection wall 433 is located above a lower end of the stopper side wall 432.

The shaft 431 is formed in a round bar shape extending in a left-right direction. The shaft 431 connects lower ends of the pair of stopper side walls 432 to each other. As shown in FIG. 10, the shaft 431 is fitted into a second support recess 82 formed in the pair of side walls 77 of the support portion 15 so as to be rotatable around a central axis. The second support recess 82 is disposed rearward of the stem 12. The stopper 430 is attached to the support portion 15 so as to be swingable in a front-rear direction around the shaft 431 in a side behind the stem 12.

As shown in FIG. 14, the restriction portion 436 protrudes forward integrally from an end of the connection wall 433 in a left-right direction and the stopper side wall 432. The restriction portion 436 is formed in a plate shape with front and back surfaces thereof facing in a left-right direction. In the restriction portion 436, a lower end 436*a* protrudes more forward than an upper portion located above the lower end 436*a*. An upper end surface of the restriction portion 436 is a flat surface orthogonal to an up-down direction.

A concave curved fitting surface 437 having a C-shape opening forward when viewed in an up-down direction is formed integrally with inner surfaces of the pair of restriction portions 436, facing each other in a left-right direction and a portion of a front surface of the connection wall 433, located between the pair of restriction portions 436. A radius of the fitting surface 437 is substantially the same as a radius of an outer peripheral surface of the stem 12. When the stopper 430 is located at the restriction position shown in FIG. 10, the fitting surface 437 is disposed coaxially with the central axis O and externally fits onto the stem 12 from a side behind the stem 12.

As shown in FIG. 14, a bulge portion 436*e* that bulges inward in a left-right direction is formed at a front end of the lower end 436*a* of the restriction portion 436. A gap between a pair of the bulge portions 436*e* in a left-right direction is smaller than the outer diameter of the stem 12.

Accordingly, when the fitting surface 437 is externally fitted onto the stem 12 and when the fitting surface 437 is removed from the stem 12, the bulge portion 436*e* of the restriction portion 436 slidably comes into contact with an outer peripheral surface of the stem 12, and thus, the lower ends 436*a* of the pair of restriction portions 436 are elastically deformed and expanded outward in a left-right direction.

When the stopper 430 is located at the restriction position shown in FIG. 10, the restriction portion 436 comes into contact with or approaches the second locking target portion 100A from below the second locking target portion 100A. More specifically, as shown in FIG. 11, when the stopper 430 is located at the restriction position, an upper end surface of the restriction portion 436 comes into contact with or approaches the flat surface (descending locking portion) 100A1 of the second locking target portion 100A from below. That is, when the stopper 430 is located at the restriction position shown in FIG. 10, an upper end surface of the restriction portion 436 functions as a second descending restriction portion 436*c* which comes into contact with or approaches the flat surface 100A1 of the second locking target portion 100A. Note that, at the restriction position, a lower end surface of the restriction portion 436 comes into contact with or approaches the upper end opening edge 15*f* of the guide tube 15*c*.

When the stopper 430 is located at the restriction release position shown in FIG. 13, the restriction portion 436 is separated rearward from the second locking target portion 100A.

As described above, the stopper 430 is disposed to be swingable between the restriction position where the first descending restriction portion 435 and the second descending restriction portion 436*c* come into contact with or approach the first locking target portion 420 and the second locking target portion 100A respectively to restrict downward movement of the discharge head 13 and the restriction release position where the first descending restriction portion 435 and the second descending restriction portion 436*c* are separated from the first locking target portion 420 and the second locking target portion 100A respectively to allow downward movement of the discharge head 13 by being swung rearward from the restriction position.

In the illustrated example, even if a large force for rotating the depressing member 16 downward around the rotation axis L is applied to the depressing member 16 in a state where the stopper 430 is located at the restriction position, a force for swinging the stopper 430 rearward around the shaft 431 is not applied to the first descending restriction portion 435 and the second descending restriction portion 436*c* from the first locking target portion 420 and the second locking target portion 100A.

As shown in FIG. 14, the knob 434 has a first arm 434*a* extending outward from the stopper side wall 432 in a left-right direction, a second arm 434*b* extending upward from an outer end of the first arm 434*a* in a left-right direction, and a finger hook 434*c* protruding upward from an upper end of the second arm 434*b*.

Figure 12:
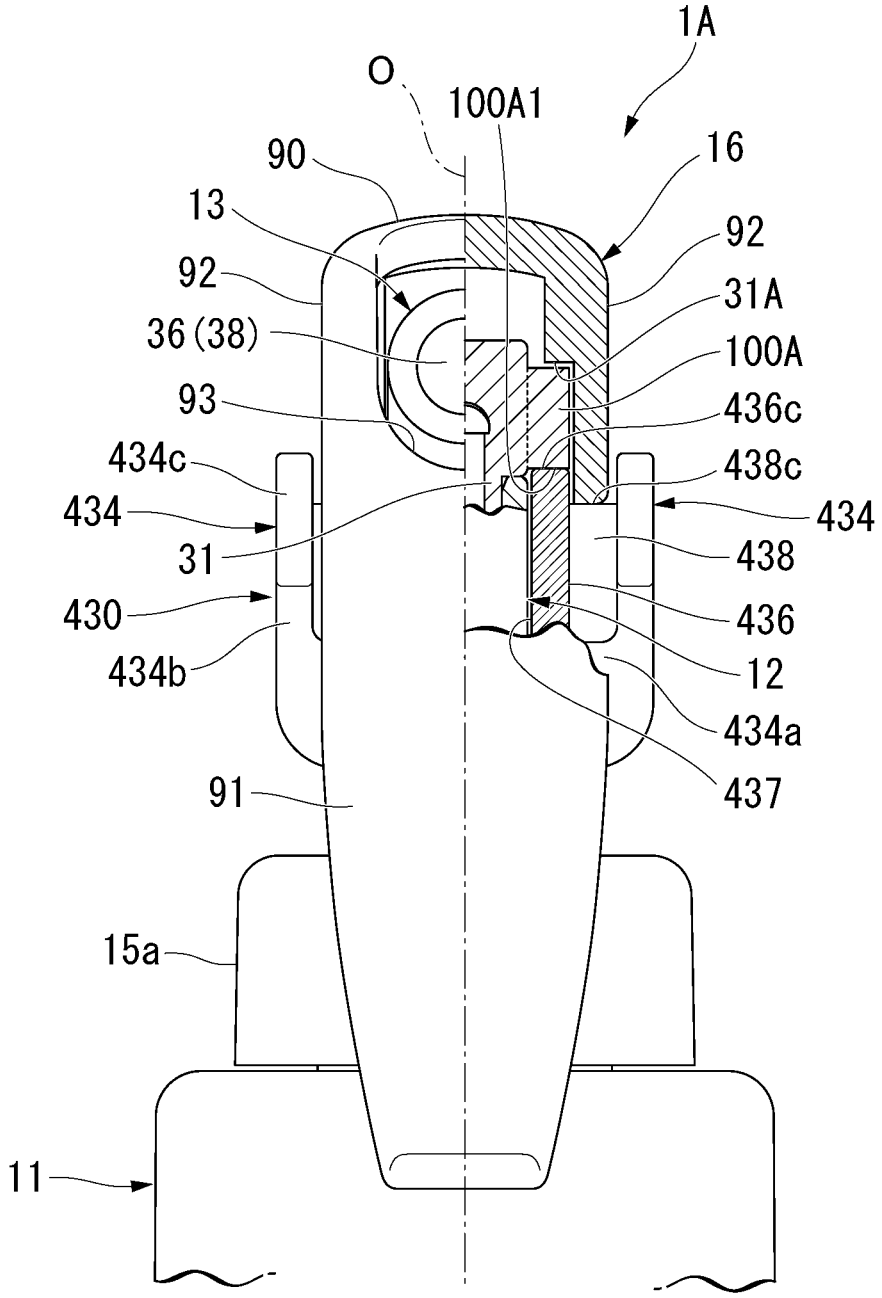
FIG. 12 is a partial sectional view of the discharger shown in FIG. 9, viewed from a side in front.

As shown in FIG. 12, an outer end of the first arm 434*a* in a left-right direction is located outward from the depressing member 16 (side plate 92) in a left-right direction. Accordingly, the second am 434*b* and the finger hook 434*c* are located outward from the depressing member 16 (side plate 92) in a left-right direction. A shape of the finger hook 434*c* in an elevation view as viewed in a left-right direction is substantially circular. The center of each of the finger hook 434*c* and the second arm 434*b* in a front-rear direction is located at the same position in a front-rear direction. The outer diameter of the finger hook 434*c* is larger than a dimension of the second arm 434*b* in a front-rear direction.

Figure 15:
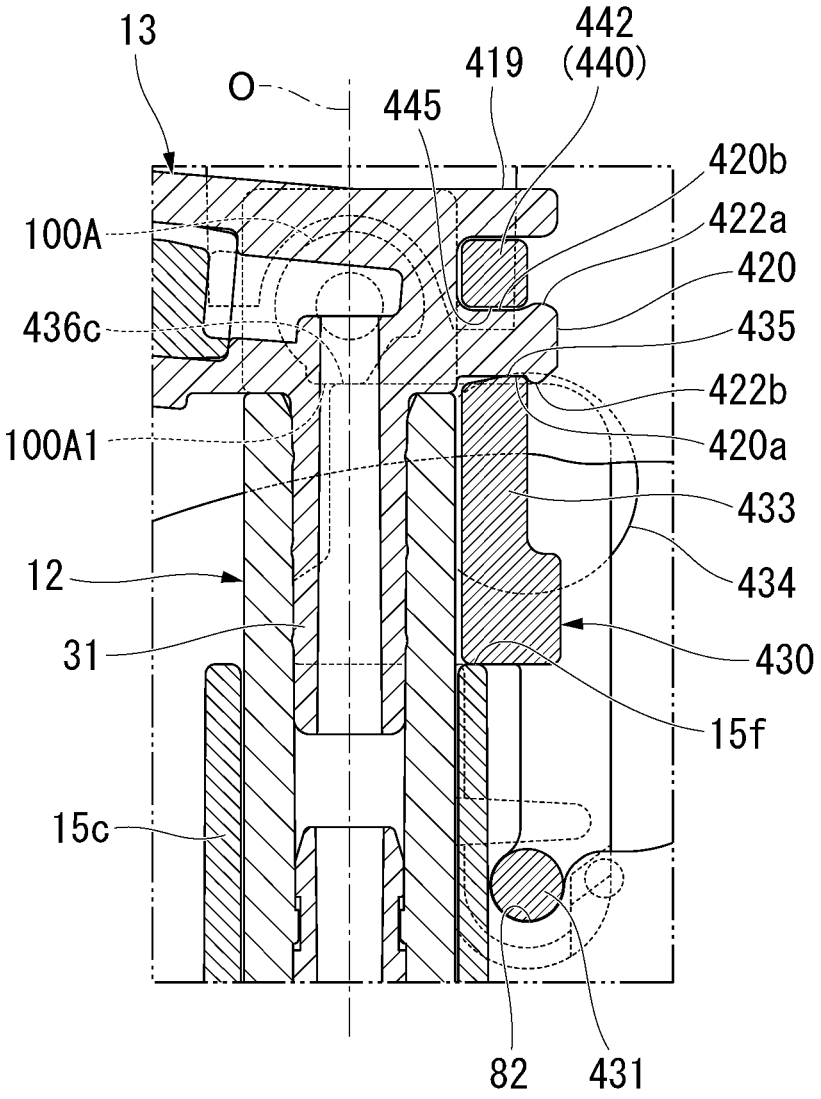
FIG. 15 is an enlarged sectional view of FIG. 10.

As shown in FIGS. 12, 14, and 15, the contact target portion 438 is disposed between the stopper side wall 432 and the knob 434 and faces a downward lower edge of the side plate 92 of the depressing member 16 from below the depressing member 16. In the illustrated example, an upper end surface 438*c* of the contact target portion 438 is in contact with or approaches a lower edge of the side plate 92 of the depressing member 16. The contact target portion 438 is located rearward of the central axis O.

In the illustrated example, when a large force for rotating the depressing member 16 downward around the rotation axis L is applied to the depressing member 16 in a state where the stopper 430 is located at the restriction position, a force for swinging the stopper 430 rearward around the shaft 431 is applied to the contact target portion 438 from the side plate 92 of the depressing member 16.

The contact target portion 438 is formed in a plate shape with front and back surfaces thereof facing in a front-rear direction and has a rectangular shape long in an up-down direction when viewed in a front-rear direction. The contact target portion 438 is integrally connected to an outer surface of the stopper side wall 432, facing outward in a left-right direction, an upper surface of the first arm 434*a* of the knob 434, an inner surface of the second arm 434*b* of the knob 434, facing inward in a left-right direction, and an inner surface of the finger hook 434*c* of the knob 434, facing inward in a left-right direction. The thickness (size in a front-rear direction) of the contact target portion 438 is smaller than the thickness of each of the first arm 434*a* and the second arm 434*b*. The contact target portion 438 is disposed at the center of each of the stopper side wall 432 and the knob 434 in a front-rear direction. Both front and rear ends of the upper end surface 438*c* of the contact target portion 438 are formed in a curved shape with rounded corners.

Then, in the present embodiment, as shown in FIGS. 14 and 15, a protruding piece 440 that protrudes upward is formed on an upper end surface of the connection wall 433. The protruding piece 440 is formed in an inverted U shape. The protruding piece 440 has a pair of up-down extending portions 441 and a left-right extending portion 442.

The up-down extending portion 441 extends upward from a portion located outward from the first descending restriction portion 435 in a left-right direction. In the up-down extending portion 441, a section shape orthogonal to an up-down direction is rectangular.

The left-right extending portion 442 bridges upper ends of the up-down extending portions 441 to each other. In the present embodiment, a portion defined by the first descending restriction portion 435 and the protruding piece 440 is an insertion opening into which the first locking target portion 420 is inserted.

Figure 10:
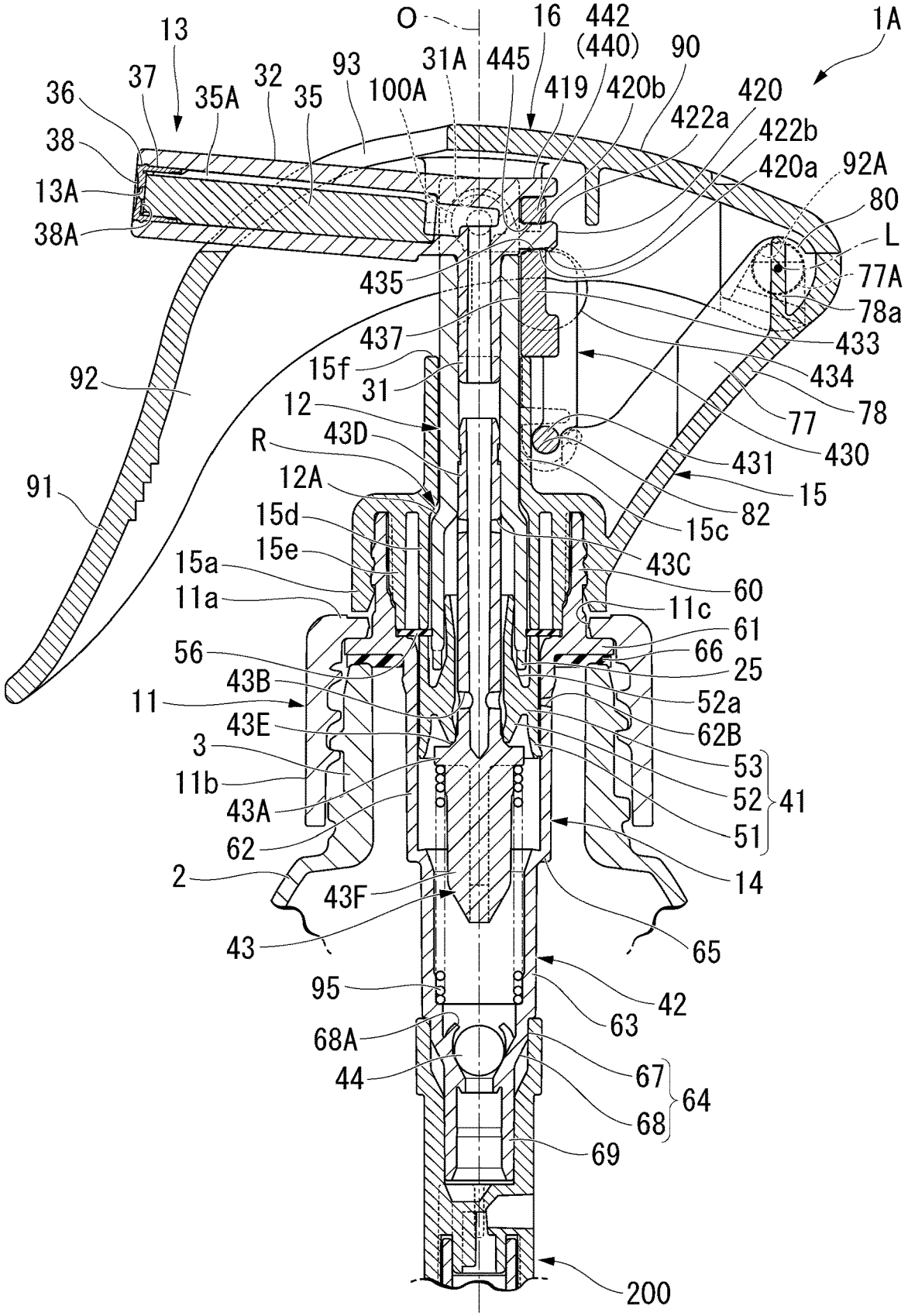
FIG. 10 is a longitudinal sectional view showing an upper half of the discharger shown in FIG. 9.
Figure 11:
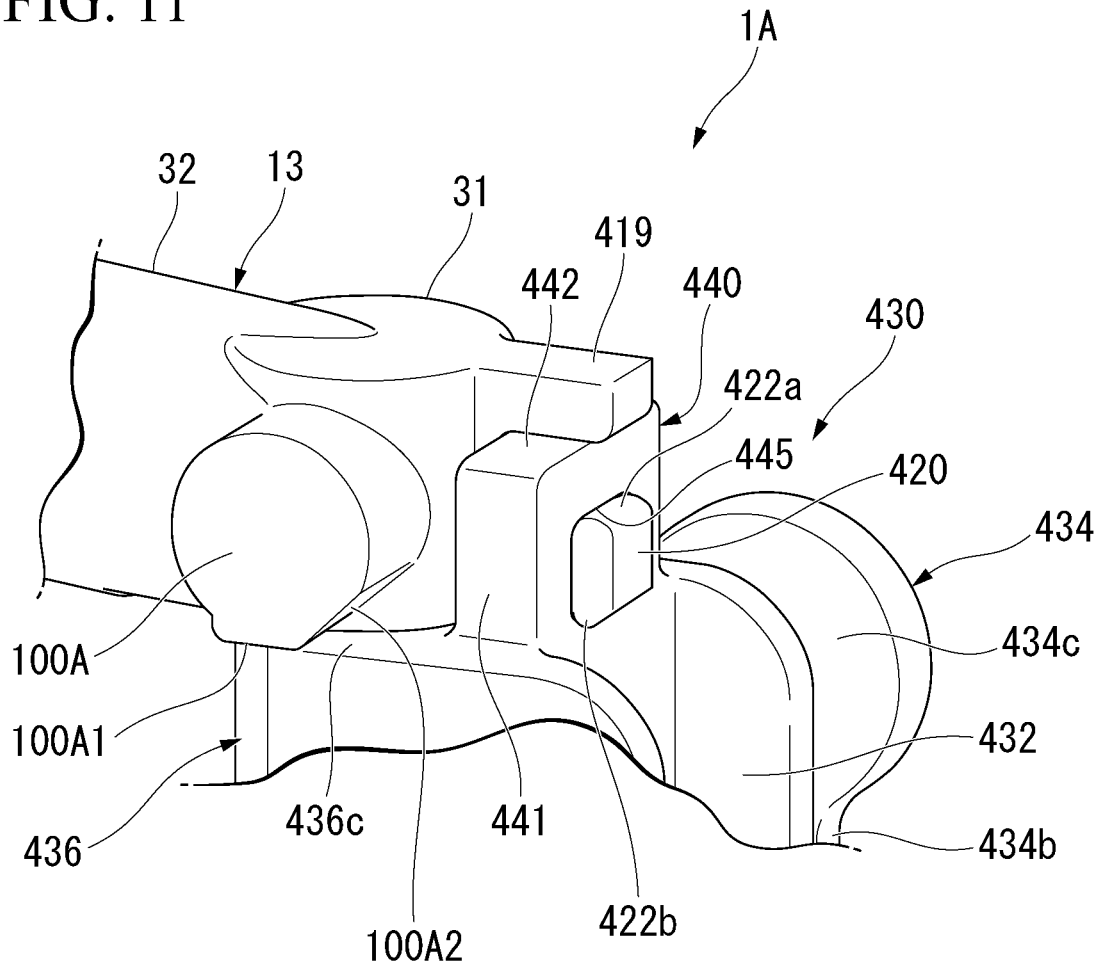
FIG. 11 is a perspective view showing a state where a depressing member is removed from the discharger shown in FIG. 9.

A lower end surface of the left-right extending portion 442 functions as a rising restriction portion 445 that restricts upward movement of the discharge head 13 with respect to the stopper 430 when the stopper 430 is located at the restriction position shown in FIG. 10. When the stopper 430 is located at the restriction position shown in FIG. 10, the rising restriction portion 445 comes into contact with or approaches an upper surface (hereinafter, referred to as a rising locking portion 420*b*) of the first locking target portion 420 of the discharge head 13 from above the first locking target portion 420. When the stopper 430 is located at the restriction position, a rear end of the rising restriction portion 445 engages with the engagement projection 422*a* from a side in front of the engagement projection 422*a*. When the stopper 430 is located at the restriction position, the rising restriction portion 445 comes into contact with on or approaches the rising locking portion 420*b*, and a lower surface of the protruding portion 419 comes into contact with or approaches an upper end surface of the left-right extending portion 442 from above.

When the stopper 430 is located at the restriction release position shown in FIG. 13, the rising restriction portion 445 is separated rearward from the first locking target portion 420.

In the present embodiment, the rising restriction portion 445 is a flat surface orthogonal to an up-down direction. Here, the shape of the rising restriction portion 445 can be changed as appropriate.

Next, a method of using the discharger 1A configured as described above will be described.

When using the discharger 1A, first, the stopper 430 is swung from the restriction position to the restriction release position on a side in rear so that the depressing member 16 and the discharge head 13 can move downward. Next, the depressing member 16 is rotated downward around the rotation axis L. At this time, for example, while hooking a fingertip on the finger hook portion of the front plate 91 of the depressing member 16, the depressing member 16 is rotated downward against a biasing force of the coil spring 95. When the depressing member 16 is rotated downward, the discharge head 13 moves downward, and the stem 12 and the piston guide 43 are depressed with respect to the cylinder 42 in a state where the valve body 44 closes the tapered tube 68 of the cylinder 42.

When the stem 12 is depressed together with the piston guide 43, the depressing force applied to the stem 12 is transmitted to the piston 41 via the elastic piece 25, and the piston 41 is integrated with the stem 12 and the piston guide 43 to move downward with respect to the cylinder 42. Accordingly, the inside of the cylinder 42 is pressurized in a state where a lower end of the inner tube piston 52 of the piston 41 blocks the communication between the inside of the stem 12 and the inside of the cylinder 42. When the stem 12 is further depressed in this state, downward movement of the piston 41 is suppressed by the increased internal pressure of the cylinder 42, and the stem 12 and the piston guide 43 move downward with respect to the piston 41.

For this reason, the stem 12 and the piston guide 43 move downward with respect to the piston 41 while elastically deforming the elastic piece 25 by applying a compression force in an up-down direction to the elastic piece 25 disposed between the stein 12 and the piston 41. At this time, a lower end of the inner tube piston 52 of the piston 41 is separated upward from the contact portion 43E of the piston guide 43, and a gap in a radial direction is formed between a lower end of the inner tube piston 52 and an outer peripheral surface of the piston guide 43. Therefore, the communication hole 43B is opened with respect to the inside of the cylinder 42 through this gap. Note that, the internal pressure of the cylinder 42 is further increased until the communication hole 43B is opened with respect to the inside of the cylinder 42.

Accordingly, the liquid content in the cylinder 42 flows into the piston guide 43 through the gap between an inner peripheral surface of the inner tube piston 52 and an outer peripheral surface of the piston guide 43 and through the communication hole 43B. Then, the liquid content flowing into the piston guide 43 flows in an upper portion of the stem 12 and reaches the nozzle tube 32, and is discharged from the discharge hole 13A of the nozzle tube 32. As a result, the liquid content accommodated in the container body 2 can be discharged to the outside through the discharge hole 13A.

Thereafter, when an operation of the depressing member 16 is released, the stem 12 and the piston 41 move to restore with respect to the cylinder 42 based on a biasing force from the coil spring 95. At this time, with upward restoring movement of the stem 12, the discharge head 13 rises, and thus the depressing member 16 is pushed upward through an inner surface of the engagement groove 31A. Accordingly, the depressing member 16 rotates upward around the rotation axis L. As such, in the present embodiment, the discharge head 13 descends as the depressing member 16 moves downward, and the depressing member 16 moves upward as the discharge head 13 rises.

That is, the discharge head 13 and the depressing member 16 move up and down in association with movement of any one thereof.

In a process of restoring movement of the stem 12 and the piston 41, a negative pressure is generated in the cylinder 42, and this negative pressure acts on the valve body 44 to open the inside of the tapered tube 68 and acts on the switching valve 225 shown in FIG. 8 through the communication channel r3. Then, when the discharger 1A is erected, the switching valve 225 maintains a state where the communication between the introduction hole 221 at the time of inversion and the communication channel r3 is blocked. As a result, the liquid content in the container body 2 reaches a lower end opening of the cylinder 42 through the introduction hole 229 at the time of erection, the inside of the main body tube 210, and the communication channel r3, and flows into the cylinder 42.

On the other hand, when the discharger 1A is inverted, a lower end opening of the pipe 213 that opens to a bottom in the container body 2 protrudes from a liquid level of the liquid content in the container main body 2. In addition, in a state where the introduction hole 221 at the time of inversion is located within the liquid content in the container body 2, the switching valve 225 is separated from an inner peripheral surface of a lower end of the upper tube 222 by own weight thereof, and the introduction hole 221 at the time of inversion and the communication channel r3 communicate with each other through the inside of the main body tube 210. Therefore, when a negative pressure is generated in the cylinder 42, the liquid content in the container body 2 reaches a lower end opening of the cylinder 42 through the introduction hole 221 at the time of inversion, the inside of the main body tube 210, and the communication channel r3, and flows into the cylinder 42.

In any case where the discharger 1A is erected or inverted, when the discharge head 13, the stem 12, and the piston 41 are integrally depressed with respect to the cylinder 42, the lower space, in the cylinder 42, located below the piston 41 is pressurized and the liquid content in the lower space rises in the stem 12 and is discharged from the discharge hole 13A. In this process, the second packing 56 opens a lower end opening of an outside air introduction channel R, the outside air introduction channel R communicates with the upper space in the cylinder 42, and outside air is introduced into the upper space in the cylinder 42.

When the discharge head 13, the stem 12, and the piston 41 are released from being depressed and are displaced to restore upward, a negative pressure is generated in the lower space in the cylinder 42, and the liquid content in the container body 2 is introduced into the lower space in the cylinder 42. In this process, the air in the upper space is introduced into the container body 2 due to the communication between the upper space in the cylinder 42 and the inside of the container body 2 through the air hole 62B.

Thereafter, when the stem 12 and the piston 41 return to an original state, the communication between the outside air introduction channel R and the upper space in the cylinder 42 is blocked by the second packing 56, and communication between the inside of the container body 2 and the outside through the outside air introduction channel R is blocked.

Note that, since the second packing 56 is disposed to block the communication between the outside air introduction channel R and the upper space in the cylinder 42, even if the discharger 1A is inverted and thus the liquid content in the container body 2 reaches the upper space in the cylinder 42, it is possible to prevent this liquid content from leaking outside through the outside air introduction channel R.

As described above, the present embodiment is configured to have the rising restriction portion 445 that, at the restriction position, comes into contact with or approaches the rising locking portion 420*b* formed in the discharge head 13 from above the rising locking portion 420*b*.

According to this configuration, in a case where an upward pulling force acts on the discharge head 13 via the depressing member 16 unexpectedly, the rising locking portion 420*b* abuts against the rising restriction portion 445 from below the rising restriction portion 445. Accordingly, the upward movement of the discharge head 13 with respect to the stem 12 can be restricted by the rising restriction portion 445. As a result, even if a large force for rotating the depressing member 16 upward around the rotation axis L is applied, the discharge head 13 can be inhibited from being pulled out of the stem 12. Note that, the term "large force" is a force necessary for the depressing member 16 to move upward around the rotation axis L from a state of non-discharge (FIG. 10 and the like). Specifically, in the present embodiment, the large force is a force of an extent to release the restriction, by the rear wall 78, of rotating upward of the depressing member 16 by deforming (plastically or elastically deforming) the rear wall 78 when the depressing member 16 is to rotate upward.

The present embodiment is configured to include the stopper 430 disposed to be swingable between the restriction position where the descending restriction portions 435 and 436*c* come into contact with or approach the flat surface 100A1 to restrict downward movement of the discharge head 13 and the restriction release position where the descending restriction portions 435 and 436*c* are separated from the flat surface 100A1 to allow downward movement of the discharge head 13 by being swung rearward from the restriction position.

According to this configuration, in a state where the stopper 430 is located at the restriction position, the descending restriction portions 435 and 436*c* come into contact with or approach the flat surface 100A1, so that the downward movement of the discharge head 13 is restricted. Therefore, it is possible to inhibit the contents from being inadvertently discharged.

On the other hand, in a state where the stopper 430 is located at the restriction release position, the depressing member 16 is rotated downward around the rotation axis L, so that the downward movement of the discharge head 13 is allowed. Accordingly, the contents can be discharged through the discharge hole 13A.

In the present embodiment, since the rising restriction portion 445 is formed in the stopper 430, it is possible to suppress an increase in the number of parts and complication of a configuration.

In the present embodiment, the rising locking portion 420*b* is formed at a portion of the discharge head 13, protruding upward from the guide tube 15*c*.

According to this configuration, the rising locking portion 420*b* can be formed irrespective of a dimension and the like of the discharge head 13 or the guide tube 15*c*, so that, it is possible to improve a degree of freedom in design, for example.

In the present embodiment, the descending locking portion 420*a* and the rising locking portion 420*b* are formed integrally with the first locking target portion 420. Therefore, it is possible to simplify a configuration as compared with a case where the descending locking portion and the rising locking portion are separately formed.

Third Embodiment

Next, a discharger 1B according to a third embodiment of the present invention will be described. In the following description, the same configuration elements as those in the first and second embodiments described above are denoted by the same reference numerals, and description thereof will be omitted as appropriate.

Figure 16:
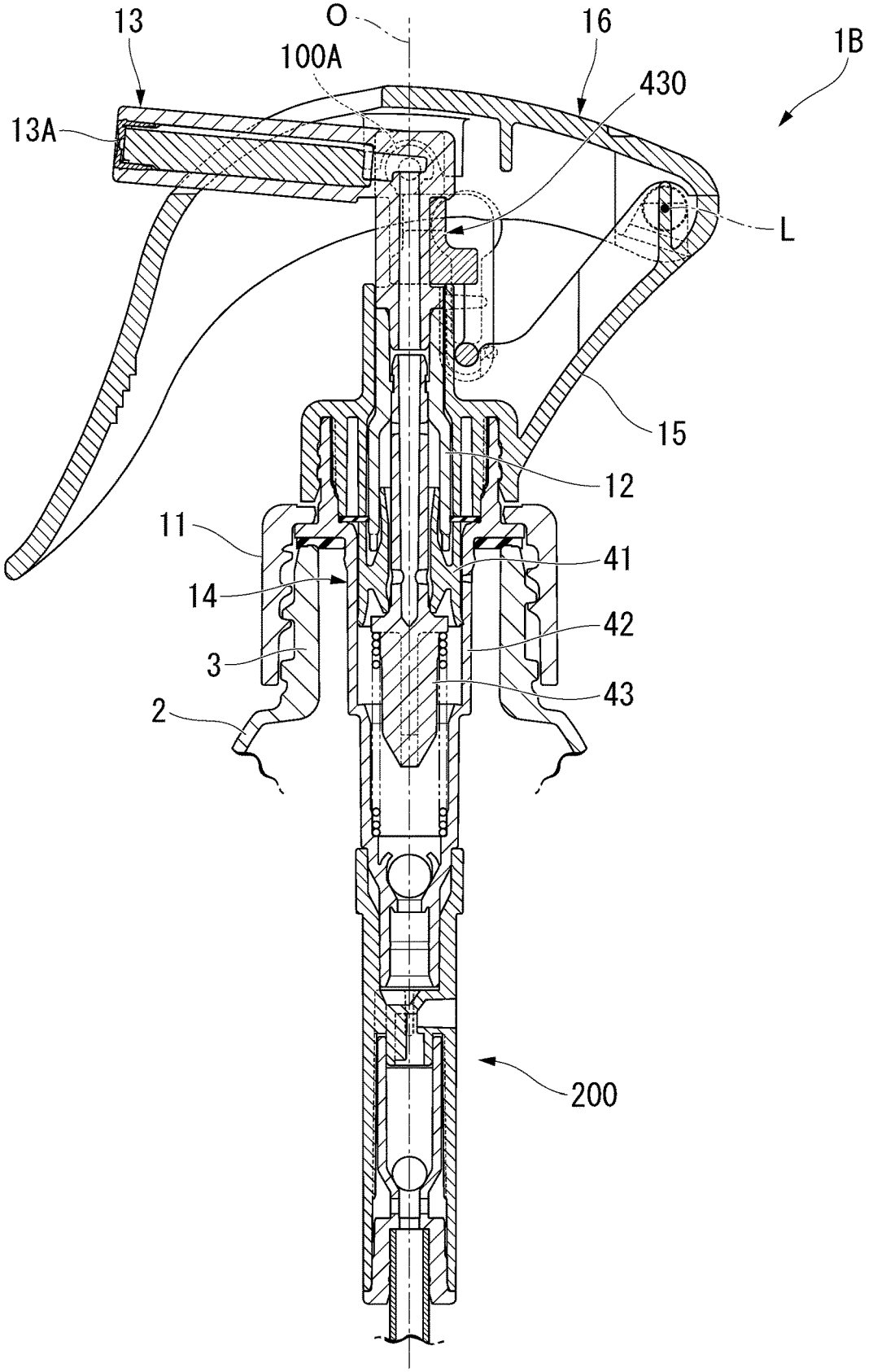
FIG. 16 is a longitudinal sectional view of a discharger according to a third embodiment of the present invention.
Figure 17:
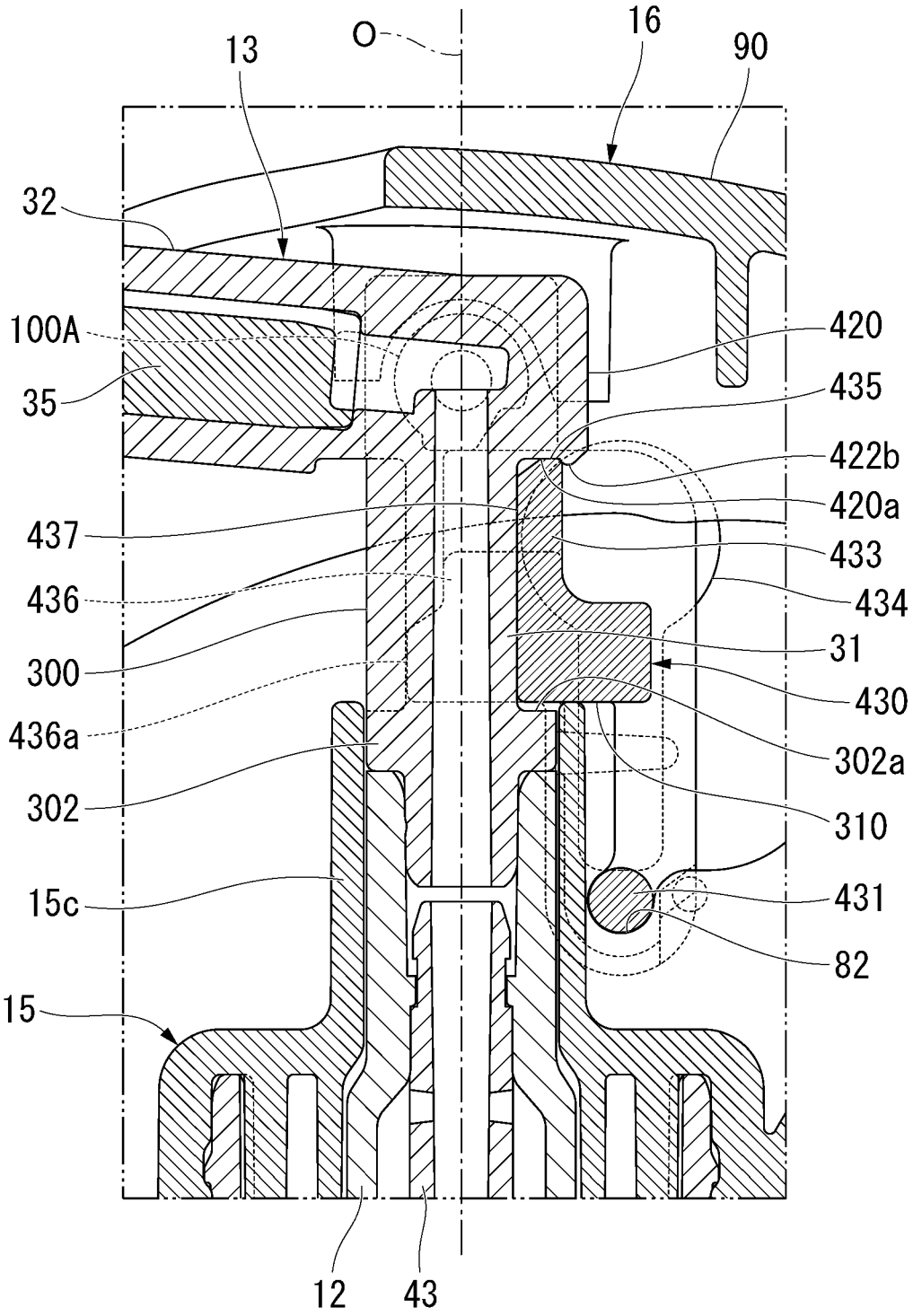
FIG. 17 is an enlarged sectional view of the discharger according to the third embodiment.

As shown in FIGS. 16 and 17, in the discharge head 13 of the discharger 1B according to the present embodiment, an abutting portion 300 that overhangs in a left-right direction is formed at a front portion of the mounting tube 31. A rear surface of the abutting portion 300 is formed as a flat surface orthogonal to a front-rear direction. At the restriction position, a front surface of the lower end 436*a* of the restriction portion 436 is in contact with or approaches a rear surface of the abutting portion 300 from a side behind the abutting portion 300. Note that, in the present embodiment, at the restriction position, the fitting surface 437 is externally fitted onto the mounting tube 31.

A restriction flange 302 that overhangs outward in a radial direction is formed at a portion of the mounting tube 31, located above the stem 12 and located inside the guide tube 15*c*. The restriction flange 302 extends over the entire circumference of the mounting tube 31. A portion of the restriction flange 302, facing the connection wall 433 in an up-down direction when the stopper 430 is at the restriction position functions as a rising locking portion 302*a*. Note that, the restriction flange 302 may be formed at a part in the circumferential direction (for example, a portion facing the rising locking portion 302*a* in an up-down direction).

At the restriction position, the connection wall 433 of the stopper 430 is located between the first locking target portion 420 and the restriction flange 302. An upper end surface of the connection wall 433 functions as the first descending restriction portion 435 that comes into contact with or approaches the descending locking portion 420*a* of the first locking target portion 420 from below the first locking target portion 420.

On the other hand, lower end surfaces of the connection wall 433 and the restriction portion 436 function as a rising restriction portion 310 which comes into contact with or approaches the rising locking portion 302*a* of the restriction flange 302 from above the restriction flange 302. In the present embodiment, the rising restriction portion 310 is in contact with or approaches an upper end opening edge of the guide tube 15*c* from above in addition to the rising locking portion 302*a*. In addition, the rising restriction portion 310 may be formed in at least one of the connection wall 433 and the restriction portion 436.

In the present embodiment, since the rising restriction portion 310 is located inside the guide tube 15*c*, rising of the discharge head 13 in a lower end of the mounting tube 31 can be restricted. Accordingly, falling down of the discharge head 13 can be reliably inhibited. Further, the design can be improved because the rising restriction portion 310 is not exposed to the outside.

Moreover, in the present embodiment, lower end surfaces of the connection wall 433 and the restriction portion 436 serve as the rising restriction portion 310, so that when the stopper 430 is at the restriction position (when the fitting surface 437 is fitted into the mounting tube 31), the rising restriction portion 310 faces over both left and right regions with respect to the central axis O in the restriction flange 302

(rising locking portion 302*a*) from a side in rear. That is, since the rising restriction portion 310 and the restriction flange 302 face each other so as to surround the periphery of the mounting tube 31, even if a large force for rotating the depressing member 16 upward around the rotation axis L is applied, the discharge head 13 can be reliably inhibited from being pulled out of the stem 12.

The present invention is not limited to the above-described embodiment, and can be appropriately changed without departing from the gist thereof.

For example, in the above-described embodiment, a configuration is shown in which the locking target portion coming into contact with or approaching the restriction portion of the stopper 130 to restrict the downward movement of the discharge head 13 is included in the discharge head 13; however, the locking target portion may be included in the depressing member 16 or may be included in both the discharge head 13 and the depressing member 16.

In the above-described embodiment, a configuration is shown in which in the contact target portion 138 (438), at least a rear end part of the upper end surface 138*c* (438*c*) with which the contact portion of the depressing member 16 comes into contact extends gradually downward as it goes rearward; however, the present invention is not limited to this, for example, the upper end surface 138*c* (438*c*) of the contact target portion 138 (438) may be appropriately changed to a flat surface orthogonal to an up-down direction over the entire region thereof.

In the above-described embodiment, a configuration is shown in which at least a part of the restraint protrusion 139 faces a rear end part of the upper end surface 138*c* of the contact target portion 138 in an up-down direction, in a state where the stopper 130 is located at the restriction position; however, the restraint protrusion 139 may be located rearward of the upper end surface 138*c* of the contact target portion 138.

A form such as a shape, a size, and a formation position of the restraint protrusion 139 is not limited to the above-described embodiment, and may be appropriately changed.

As described in the above embodiment, when the stopper 130 is located at the restriction position, the stopper comes into contact with the first locking target portion 120 and the second locking target portion 100A; however, the stopper 130 may approach the first locking target portion 120 and the second locking target portion 100A even if the stopper does not come into contact therewith, and even in this case, it is possible to restrict the downward movement of the discharge head 13.

Further, the discharger 1 (1A, 1B) may not include the invertible adapter 200. In this case, the pipe 213 is attached to a lower end of the cylinder 42.

In the above-described embodiment, a configuration is shown in which the descending locking portion coming into contact with or approaching the descending restriction portion of the stopper 430 to restrict the downward movement of the discharge head 13 is included in the discharge head 13; however, the descending locking portion may be included in the depressing member 16 or may be included in both the discharge head 13 and the depressing member 16. Further, the rising locking portion may be included in the depressing member 16 or may be included in both the discharge head 13 and the depressing member 16.

In the above-described embodiment, a configuration is described in which the stopper 430 is provided with the rising restriction portion; however, the present invention is not limited to only this configuration. For example, a configuration in which the stein 12 is provided with a rising restriction portion may be employed. In addition, a rising restriction portion may be provided separately from the stem 12 or the stopper 430.

In the above-described embodiment, a configuration is shown in which in the contact target portion 438, at least a rear end of the upper end surface 438*c* with which the contact portion of the depressing member 16 comes into contact extends gradually downward as it goes rearward; however, the present invention is not limited to this, for example, the upper end surface 438*c* of the contact target portion 438 may be appropriately changed to a flat surface orthogonal to an up-down direction over the entire region thereof.

In the above-described embodiment, the stopper 430 is configured to include both the rising restriction portion and the descending restriction portion; however, the stopper may have only at least the rising restriction portion.

In addition, it is possible to appropriately replace the configuration elements in the above-described embodiments with well-known configuration elements without departing from the gist of the present invention, and the above-described modifications may be appropriately combined.

INDUSTRIAL APPLICABILITY

The present invention can be used for a discharger that is mounted on a mouth portion of a container body in which contents are accommodated and discharges the contents from a discharge hole.

DESCRIPTION OF REFERENCE SIGNS

1, 1A, 1B Discharger
2 Container body
3 Mouth portion
11 Mounting cap
12 Stem
13 Discharge head
13A Discharge hole
14 Pump
15 Support portion
15*c* Guide tube
16 Depressing member
100A Second locking target portion (locking target portion)
100A1 Flat surface (descending locking portion)
120 First locking target portion (locking target portion)
130 Stopper
134*c* finger hook
135 First restriction portion (restriction portion)
136 Second restriction portion (restriction portion)
138 Contact target portion
138*c* Upper end surface of contact target portion
139 Restraint protrusion
302*a* Rising locking portion
310, 445 Rising restriction portion
420*a* Descending locking portion
430 Stopper
435 First descending restriction portion (descending restriction portion)
436*c* Second descending restriction portion (descending restriction portion)
L Rotation axis

The invention claimed is:

1. A discharger, comprising:

a pump including a discharge head that is disposed on a mouth portion of a container body, in which contents are accommodated, so as to be movable downward in an upward force-applied state, the discharge head being provided with a discharge hole opening forward;

a mounting cap with which the pump is mounted on the mouth portion of the container body;

a support portion erected on a rear portion of the mounting cap; and a depressing member that is disposed on the support portion so as to be rotatable around a rotation axis and depresses the discharge head, wherein the discharger is configured to discharge the contents from the discharge hole by rotating the depressing member downward around the rotation axis to move the discharge head downward, wherein the discharger comprises a stopper that is disposed to be swingable in a front-rear direction and that includes a restriction portion coming into contact with or approaching a locking target portion formed in at least one of the discharge head and the depressing member from below the locking target portion, wherein the stopper is disposed to be swingable between a restriction position where the restriction portion comes into contact with or approaches the locking target portion to restrict downward movement of the discharge head and a restriction release position where the restriction portion is separated from the locking target portion to allow downward movement of the discharge head by the stopper being swung rearward from the restriction position, wherein the stopper includes the restriction portion, a finger hook located outward from the depressing member in a left-right direction orthogonal to both of the front-rear direction and an up-down direction, and a contact target portion that comes into contact with the depressing member when the stopper is located at the restriction position or when the depressing member rotates downward around the rotation axis in a state where the stopper is located at the restriction position, and wherein a restraint protrusion protruding downward is formed at a portion of the depressing member located rearward of a contact portion with which the contact target portion of the stopper comes into contact.

2. The discharger according to claim 1, wherein in the contact target portion, at least a rear end part of an upper end surface with which the contact portion of the depressing member comes into contact extends gradually downward as it goes rearward.

3. The discharger according to claim 2, wherein at least a part of the restraint protrusion faces the rear end part of the upper end surface of the contact target portion in a state where the stopper is located at the restriction position.

4. A discharger, comprising:

a pump including a stem that is disposed on a mouth portion of a container body, in which contents are accommodated, so as to be movable downward in an upward force-applied state, and a discharge head mounted on the stem and provided with a discharge hole opening forward;

a mounting cap with which the pump is mounted on the mouth portion of the container body;

a support portion erected on a rear portion of the mounting cap; and a depressing member that is disposed on the support portion so as to be rotatable around a rotation axis and is linked to the discharge head, wherein the discharger is configured to discharge the contents from the discharge hole by rotating the depressing member downward around the rotation axis to move the discharge head downward, and wherein the discharger comprises a rising restriction portion coming into contact with or approaching a rising locking portion formed in at least one of the discharge head and the depressing member from above the rising locking portion.

5. The discharger according to claim 4, comprising:

a stopper that is disposed to be swingable in a front-rear direction and that includes a descending restriction portion coming into contact with or approaching a descending locking portion formed in at least one of the discharge head and the depressing member from below the descending locking portion, wherein the stopper is disposed to be swingable between a restriction position where the descending restriction portion comes into contact with or approaches the descending locking portion to restrict downward movement of the discharge head and a restriction release position where the descending restriction portion is separated from the descending locking portion to allow downward movement of the discharge head by the stopper being swung rearward from the restriction position.

6. The discharger according to claim 5, wherein the rising restriction portion is formed in the stopper.

7. The discharger according to claim 4, wherein the support portion includes a guide tube into which the stem is inserted to be movable downward, and wherein the rising locking portion is formed at a portion of the discharge head protruding upward from the guide tube.

8. The discharger according to claim 4, wherein the support portion includes a guide tube into which the stem is inserted to be movable downward, and wherein the rising locking portion is formed at a portion of the discharge head located inside the guide tube.

9. The discharger according to claim 5, wherein the support portion includes a guide tube into which the stem is inserted to be movable downward, and wherein the rising locking portion is formed at a portion of the discharge head protruding upward from the guide tube.

10. The discharger according to claim 6, wherein the support portion includes a guide tube into which the stem is inserted to be movable downward, and wherein the rising locking portion is formed at a portion of the discharge head protruding upward from the guide tube.

11. The discharger according to claim 5, wherein the support portion includes a guide tube into which the stem is inserted to be movable downward, and wherein the rising locking portion is formed at a portion of the discharge head located inside the guide tube.

12. The discharger according to claim 6, wherein the support portion includes a guide tube into which the stem is inserted to be movable downward, and wherein the rising locking portion is formed at a portion of the discharge head located inside the guide tube.

* * * * *